US010837298B2

(12) United States Patent
Parker et al.

(10) Patent No.: US 10,837,298 B2
(45) Date of Patent: Nov. 17, 2020

(54) FIRST STAGE TURBINE NOZZLE

(71) Applicant: Chromalloy Gas Turbine LLC, Palm Beach Gardens, FL (US)

(72) Inventors: David G. Parker, Jupiter, FL (US); Zhenhua Xiao, Palm Beach Gardens, FL (US); Richard Yu, Wellington, FL (US); Vincent C. Martling, Wellington, FL (US); Mariano Medrano, Jr., Okeechobee, FL (US); Charles A. Ellis, Stuart, FL (US)

(73) Assignee: Chromalloy Gas Turbine LLC, Palm Beach Gardens, FL (US)

( * ) Notice: Subject to any disclaimer, the term of this patent is extended or adjusted under 35 U.S.C. 154(b) by 112 days.

(21) Appl. No.: 16/107,408

(22) Filed: Aug. 21, 2018

(65) Prior Publication Data

US 2020/0063579 A1 Feb. 27, 2020

(51) Int. Cl.
*F01D 9/04* (2006.01)
*F01D 25/00* (2006.01)

(52) U.S. Cl.
CPC ..... *F01D 9/041* (2013.01); *F01D 25/005* (2013.01); *F05D 2220/3212* (2013.01); *F05D 2240/128* (2013.01); *F05D 2250/74* (2013.01); *F05D 2300/173* (2013.01); *F05D 2300/611* (2013.01)

(58) Field of Classification Search
None
See application file for complete search history.

(56) References Cited

U.S. PATENT DOCUMENTS

| | | | | |
|---|---|---|---|---|
| 6,503,054 | B1 * | 1/2003 | Bielek | F01D 5/141 415/191 |
| 6,722,853 | B1 * | 4/2004 | Humanchuk | F01D 5/141 416/223 A |
| 6,736,599 | B1 * | 5/2004 | Jacks | F01D 5/141 415/191 |
| 6,769,878 | B1 * | 8/2004 | Parker | F01D 5/141 416/223 A |
| 7,329,092 | B2 * | 2/2008 | Keener | F01D 5/141 415/191 |
| 2004/0175271 | A1 * | 9/2004 | Coke | F01D 5/141 416/223 A |
| 2005/0025618 | A1 * | 2/2005 | Arness | F01D 5/141 415/191 |
| 2005/0111978 | A1 * | 5/2005 | Strohl | F01D 5/141 416/97 R |
| 2006/0024168 | A1 * | 2/2006 | Fukuda | F01D 5/141 416/223 R |

(Continued)

*Primary Examiner* — Michael Lebentritt
(74) *Attorney, Agent, or Firm* — Avant Law Group, LLC

(57) ABSTRACT

A turbine nozzle having an airfoil profile substantially in accordance with Cartesian coordinate values of X, Y, and Z set forth in Table 1, and within an envelope of approximately +/−0.049 inches, where the X and Y values are in inches and the Z values are non-dimensional values from 0 to 1 and convertible to Z distances in inches by multiplying the Z values by the height of the airfoil in inches. The X and Y values are distances which, when connected by smooth continuing arcs, define airfoil profile sections at each distance Z. The profile sections at each distance Z are joined smoothly to one another to form the airfoil shape. The X and Y values may also be scaled as a function of a first constant and the Z values may be scaled as a function of a second constant.

20 Claims, 2 Drawing Sheets

(56) References Cited

U.S. PATENT DOCUMENTS

| | | | | |
|---|---|---|---|---|
| 2007/0177981 | A1* | 8/2007 | Vandeputte | F01D 5/141<br>416/223 R |
| 2008/0101925 | A1* | 5/2008 | Humanchuk | F01D 9/041<br>415/208.1 |
| 2008/0124480 | A1* | 5/2008 | Shen | C23C 4/08<br>427/456 |
| 2013/0294913 | A1* | 11/2013 | Campbell | F01D 5/16<br>416/145 |

* cited by examiner

FIRST STAGE TURBINE NOZZLE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

This invention disclosure relates generally to a turbine vane for use in a gas turbine engine and more specifically to surface profiles for a first stage turbine vane.

BACKGROUND OF THE INVENTION

A gas turbine engine typically comprises a multi-stage compressor coupled to a multi-stage turbine via an axial shaft. Air enters the gas turbine engine through the compressor where its temperature and pressure are increased as it passes through subsequent stages of the compressor. The compressed air is then directed to one or more combustors where it is mixed with a fuel source to create a combustible mixture. This mixture is ignited in the combustors to create a flow of hot combustion gases. These gases are directed into the turbine causing the turbine to rotate, thereby driving the compressor. The output of the gas turbine engine can be mechanical thrust through exhaust from the turbine or shaft power from the rotation of an axial shaft, where the axial shaft can drive a generator to produce electricity.

The compressor and turbine each comprise a plurality of rotating blades and stationary vanes having an airfoil extending into the flow of compressed air or flow of hot combustion gases. Each blade or vane has a particular set of design criteria which must be met in order to provide the necessary work to the passing flow through the compressor and the turbine. However, due to the severe nature of the operating environments especially prevalent in the turbine, it is beneficial to optimize the performance of the airfoil.

BRIEF SUMMARY OF THE INVENTION

The present invention discloses a turbine vane, also referred to as a turbine nozzle, having an improved airfoil configuration for use in a gas turbine engine. More specifically, the turbine nozzle comprises a first stage turbine nozzle for use in a large frame gas turbine engine.

In an embodiment of the present invention, a turbine nozzle comprises an airfoil having a shape within an envelope of approximately −0.049 to +0.049 inches in a direction normal to any surface of the airfoil, the airfoil comprising a nominal uncoated profile substantially in accordance with Cartesian coordinate values of X, Y, and Z set forth in Table 1. The Z values are non-dimensional values from 0 to 1 convertible to Z distances in inches by multiplying the Z values by a height of the airfoil in inches and adding that product to a root radius of the turbine nozzle. X and Y are distances in inches which, when connected by a smooth continuing arc, define airfoil profile sections at each Z value. The profile sections at the Z values being joined smoothly with one another to form a complete airfoil shape. The airfoil is secured to an inner radial platform at its root and to an outer radial platform at its tip.

In an alternate embodiment of the present invention, a turbine nozzle comprising an airfoil is provided, the airfoil having a shape comprising a nominal uncoated profile substantially in accordance with Cartesian coordinate values of X, Y, and Z set forth in Table 1. The Z values are non-dimensional values from 0 to 1 convertible to Z distances in inches by multiplying the Z values by a height of the airfoil in inches and adding that product to a root radius of the turbine nozzle. X and Y are distances in inches which, when connected by a smooth continuing arc, define airfoil profile sections at each distance Z. The profile sections at the Z distances being joined smoothly with one another to form a complete airfoil shape.

In yet another embodiment, an assembly of first stage turbine nozzles is provided where each nozzle comprises an airfoil having a shape within an envelope of approximately −0.049 to +0.049 inches in a direction normal to any surface of the airfoil. The airfoil comprises a nominal uncoated profile substantially in accordance with Cartesian coordinate values of X, Y, and Z set forth in Table 1. The Z values are non-dimensional values from 0 to 1 convertible to Z distances in inches by multiplying the Z values by a height of the airfoil in inches and adding that product to a root radius of the turbine nozzle. X and Y are distances in inches which, when connected by a smooth continuing arc, define airfoil profile sections at each distance Z, the profile sections at the Z distances being joined smoothly with one another to form a complete airfoil shape.

These and other features of the present invention can be best understood from the following description and claims.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

The present invention is intended for use in a gas turbine engine, such as a gas turbine used for power generation. As such, the present invention is capable of being used in a variety of turbine operating environments, regardless of the manufacturer.

As those skilled in the art will readily appreciate, such a gas turbine engine is circumferentially disposed about an engine centerline, or axial centerline axis. The engine includes a compressor, a combustion section and a turbine with the turbine coupled to the compressor via an engine shaft. As is well known in the art, air compressed in the compressor is mixed with fuel which is burned in the combustion section and expanded in turbine. The air compressed in the compressor and the fuel mixture expanded in the turbine can both be referred to as a "hot gas stream flow." The turbine includes rotors that, in response to the fluid expansion, rotate, thereby driving the compressor. The turbine comprises alternating rows of rotary turbine blades, and static airfoils, often referred to as vanes or nozzles.

Figure 1:
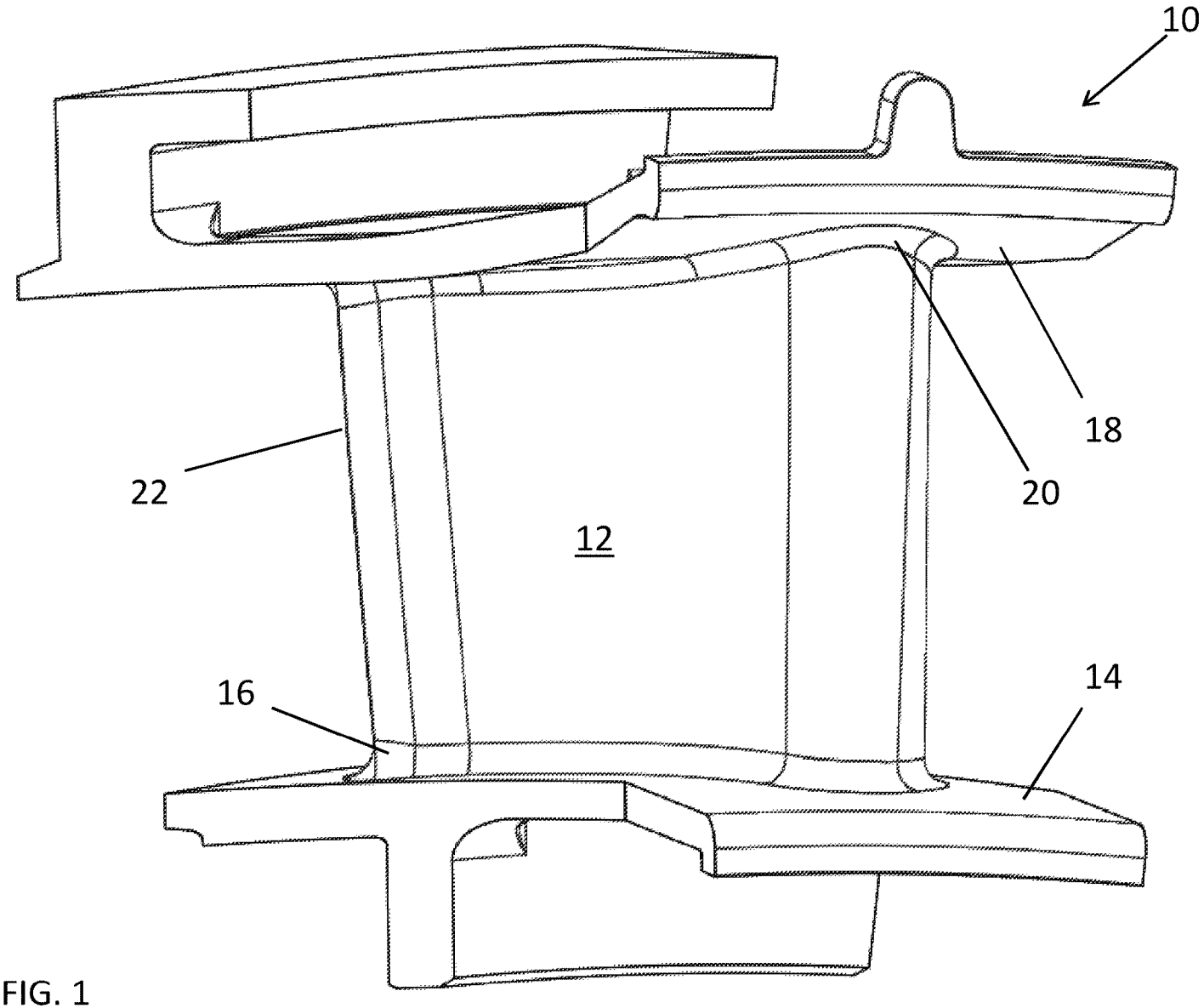
FIG. 1 is a perspective view of a turbine nozzle in accordance with an embodiment of the present invention.
Figure 2:
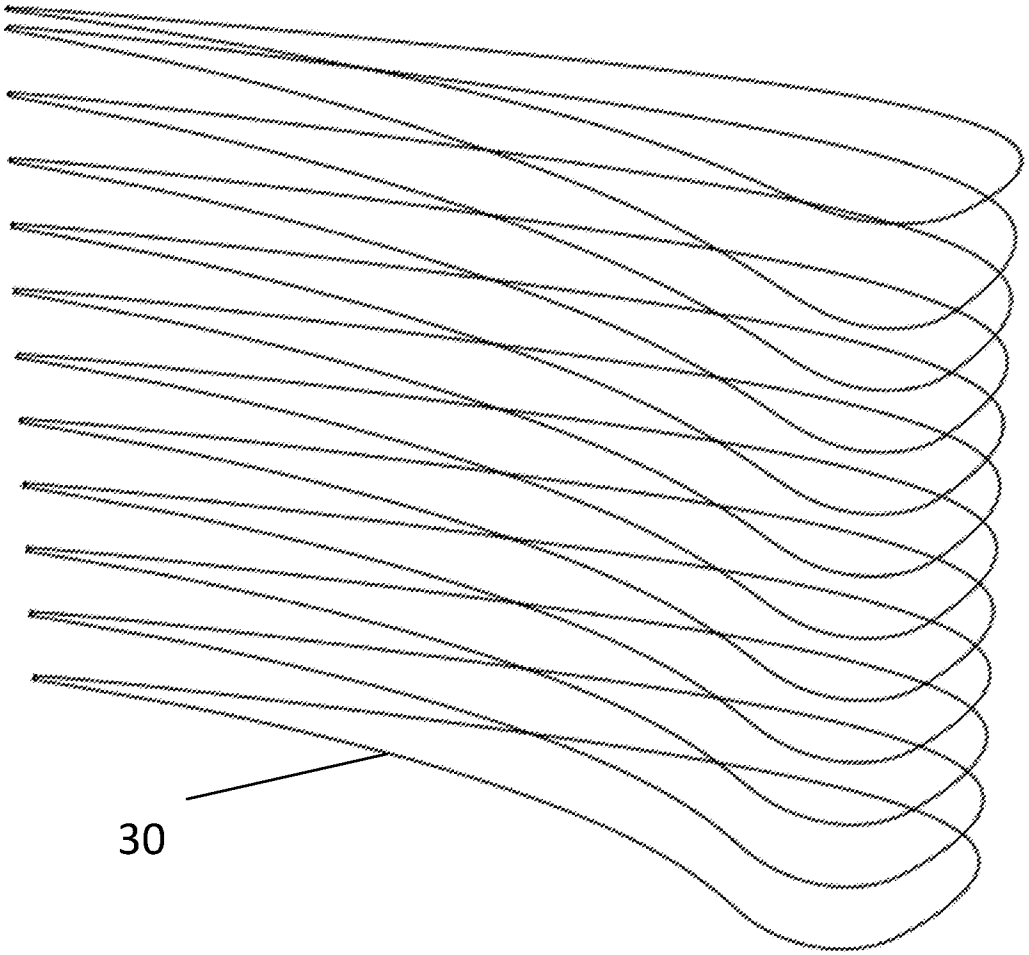
FIG. 2 is a perspective view of a series of airfoil sections formed by the Cartesian coordinates of Table 1 for the turbine nozzle of FIG. 1.

A turbine nozzle in accordance with embodiments of the present invention is shown in FIGS. 1 and 2. Referring initially to FIG. 1, a perspective view of a turbine nozzle 10 is shown. The turbine nozzle 10 comprises an airfoil 12 having a shape that is within an envelope of approximately +0.049 to −0.049 inches in a direction normal to any surface of the airfoil 12. This envelope accounts for a variety of manufacturing tolerances that may occur as a result of the casting and machining processes. The airfoil 12 has a nominal uncoated profile that is substantially in accordance with the Cartesian coordinate values of X, Y, and Z as set forth in Table 1 below. The Z values are non-dimensional values from 0 to 1 and are convertible to Z distances in inches by multiplying the Z values by a height of the airfoil in inches and adding that product to a root radius of the turbine nozzle. The airfoil height can vary, but for one embodiment, airfoil 12 can extend approximately seven inches. The root radius can vary depending on the nozzle configuration, but in one embodiment is approximately 49 inches. The X and Y values are distances in inches and when connected by a smooth continuing arc, define an airfoil profile section 30 at each Z value. The plurality of airfoil sections 30 are depicted in FIG. 2. The airfoil 12 is formed by taking the airfoil sections 30 at each Z value and joining them together smoothly.

The turbine nozzle 10, which forms part of a first stage turbine, also comprises an inner radial platform 14 that is secured to the airfoil 12 at a root 16 of the airfoil and an outer radial platform 18 secured to the airfoil 12 at the tip 20 of the airfoil 12.

The Z value is measured from a distance midway along an axial length of the inner radial platform 14. While the present airfoil may be scaled to different size turbine engines, a representative height of the airfoil 12 for one particular embodiment of the present invention is approximately seven inches.

In order to promote efficiency of design and reduce overall design cost of gas turbine engines, manufacturers will often try and use similar parts or scaled parts where possible. For the present invention, the X and Y distances are scalable as a function of the same constant number so as to provide a scaled up or scaled down nozzle airfoil.

While the airfoil 12 shown in FIGS. 1 and 2 and detailed in Table 1 is uncoated, it is possible, and often likely, that due to engine operating temperatures, it may be necessary to coat the external surfaces of the airfoil 12 with a thermal barrier coating to protect the airfoil 12 from erosion due to the elevated operating temperatures. One such coating that can be applied to the airfoil 12 includes a metallic MCrAlY with a diffused aluminide overlay applied up to approximately 0.012 inches thick and a thermal barrier coating applied approximately 0.023 inches over the metallic MCrAlY coating. As such, an acceptable coating thickness is up to approximately 0.035 inches. Such acceptable coatings are applied to all surfaces of the airfoil 12 between the inner radial platform 14 and the outer radial platform 18. As a result of the thermal barrier coating being added to the profile variation of the airfoil, the overall envelope of the finished airfoil can be approximately −0.049 inches to +0.085 inches from nominal.

Although not depicted in detail, the turbine nozzle of FIG. 1 is typically cooled to lower its effective operating temperature. A variety of cooling fluids may be used to accomplish this cooling. However, one common cooling fluid is compressed air from the engine compressor. A supply of cooling air is directed through internal cavities of the turbine nozzle and discharged along an outer surface of the nozzle or adjacent a trailing edge 22 of the turbine nozzle.

In an alternate embodiment of the present invention, a turbine nozzle 10 is provided having an airfoil 12, where the airfoil 12 has a shape comprising a nominal uncoated profile substantially in accordance with Cartesian coordinate values of X, Y, and Z set forth in Table 1. The Z values are non-dimensional values from 0 to 1 convertible to Z distances in inches by multiplying the Z values by a height of the airfoil 12 in inches and adding that product to a root radius of the turbine nozzle. X and Y values are distances in inches which, when connected by a smooth continuing arc, define airfoil profile sections 30 at each distance Z, as shown in FIG. 2. The profile sections 30 at the Z distances are joined smoothly with one another to form a complete airfoil shape.

The values of Table 1 for determining the profile of the airfoil are generated and shown to three decimal places. These values in Table 1 are for a nominal, uncoated airfoil. However, there are typical manufacturing tolerances as well as coatings, which can cause the profile of the airfoil to vary from the values of Table 1. Thus, in an alternate embodiment of the present invention, a turbine nozzle 10, as disclosed above, is provided where the airfoil shape of the cast vane lies in an envelope within +/−0.049 inches in a direction normal to any surface location. That is, due to a variety of manufacturing issues such as variations that occur in the airfoil casting and machining processes of turbine nozzle 10, the exact location of the airfoil shape can vary by up to approximately +/−0.049 inches. However, such variations in the airfoil profile still result in an airfoil fully within the desired performance of a first stage turbine blade that is within the scope of the present invention.

The present invention can also be used in a variety of turbine applications. That is, the airfoil 12 is designed such that its profile is scalable for use in a variety of gas turbine engines. In order to scale the airfoil 12, the X and Y values are multiplied by a first constant, which can be greater or less than 1.0, and the Z values are multiplied by a second constant. Typically, the X and Y values are multiplied by the same constant while the Z values are multiplied by a second constant, which may be different from the first constant.

In addition to scaling the airfoil 12, the orientation of the airfoil can also change in alternate embodiments of the present invention. More specifically, the airfoil orientation can rotate with respect to an axis extending radially outward from each airfoil section, or along the Z values. This axis can be the stacking axis of the airfoil 12. As one skilled in the art will understand, rotating the orientation of the airfoil 12 can reconfigure the aerodynamic loading on the nozzle, resulting in a change in airflow direction by the turbine nozzle 10 as well as the mechanical stresses on the nozzle.

In yet another embodiment of the present invention, an assembly of first stage turbine nozzles is provided. A plurality of nozzles positioned adjacent to each other in a ring have an airfoil with a shape within an envelope of approximately +/−0.049 inches in a direction normal to any surface of the airfoil. The airfoil comprises a nominal uncoated profile substantially in accordance with Cartesian coordinate values of X, Y, and Z set forth in Table 1. The Z values are non-dimensional values from 0 to 1 convertible to Z distances in inches by multiplying the Z values by a height of the airfoil in inches and adding that product to a root radius of the turbine nozzle. The X and Y values are distances in inches which, when connected by smooth continuing arc, define airfoil profile sections at each distance Z. Then, the profile sections at the Z distances are joined smoothly with one another to form a complete airfoil shape.

The turbine nozzle 10 of the present invention has an airfoil 12 that has been designed with many unique features. More specifically, turbine nozzle 10 has a modified radial distribution of the throat area to reduce secondary losses. The nozzle also reduces peak Mach numbers and losses due to shock. Total pressure loss across the nozzle 10 is reduced by about 0.98% relative to prior nozzle designs.

The coordinate values given in Table 1 below provide a nominal profile envelope for the airfoil disclosed herein.

TABLE 1

| X | Y | Z |
|---|---|---|
| 2.775 | 4.287 | 0.000 |
| 2.977 | 4.843 | 0.000 |
| 2.977 | 4.843 | 0.000 |
| 2.978 | 4.845 | 0.000 |
| 2.980 | 4.847 | 0.000 |
| 2.982 | 4.848 | 0.000 |
| 2.984 | 4.849 | 0.000 |
| 2.987 | 4.850 | 0.000 |
| 2.989 | 4.849 | 0.000 |
| 2.989 | 4.849 | 0.000 |
| 3.034 | 4.837 | 0.000 |
| 3.034 | 4.837 | 0.000 |
| 3.037 | 4.836 | 0.000 |
| 3.038 | 4.835 | 0.000 |
| 3.040 | 4.833 | 0.000 |
| 3.041 | 4.831 | 0.000 |
| 3.042 | 4.828 | 0.000 |
| 3.042 | 4.826 | 0.000 |
| 3.042 | 4.826 | 0.000 |
| 2.989 | 4.461 | 0.000 |
| 2.921 | 4.092 | 0.000 |
| 2.921 | 4.092 | 0.000 |
| 2.862 | 3.809 | 0.000 |
| 2.798 | 3.509 | 0.000 |
| 2.763 | 3.352 | 0.000 |
| 2.726 | 3.190 | 0.000 |
| 2.688 | 3.025 | 0.000 |
| 2.649 | 2.861 | 0.000 |
| 2.609 | 2.694 | 0.000 |
| 2.568 | 2.525 | 0.000 |
| 2.527 | 2.358 | 0.000 |
| 2.486 | 2.197 | 0.000 |
| 2.447 | 2.043 | 0.000 |
| 2.408 | 1.894 | 0.000 |
| 2.333 | 1.609 | 0.000 |
| 2.260 | 1.343 | 0.000 |
| 2.191 | 1.093 | 0.000 |
| 2.061 | 0.639 | 0.000 |
| 1.940 | 0.240 | 0.000 |
| 1.882 | 0.055 | 0.000 |
| 1.824 | −0.121 | 0.000 |
| 1.711 | −0.452 | 0.000 |
| 1.657 | −0.602 | 0.000 |
| 1.605 | −0.741 | 0.000 |
| 1.505 | −0.994 | 0.000 |
| 1.412 | −1.212 | 0.000 |
| 1.325 | −1.400 | 0.000 |
| 1.243 | −1.563 | 0.000 |
| 1.203 | −1.639 | 0.000 |
| 1.163 | −1.711 | 0.000 |
| 1.083 | −1.849 | 0.000 |
| 1.008 | −1.966 | 0.000 |
| 0.938 | −2.066 | 0.000 |
| 0.871 | −2.151 | 0.000 |
| 0.805 | −2.227 | 0.000 |
| 0.741 | −2.294 | 0.000 |
| 0.677 | −2.354 | 0.000 |
| 0.614 | −2.407 | 0.000 |
| 0.552 | −2.454 | 0.000 |
| 0.493 | −2.494 | 0.000 |
| 0.436 | −2.527 | 0.000 |
| 0.383 | −2.555 | 0.000 |
| 0.333 | −2.577 | 0.000 |
| 0.286 | −2.595 | 0.000 |
| 0.239 | −2.608 | 0.000 |
| 0.191 | −2.619 | 0.000 |
| 0.141 | −2.628 | 0.000 |
| 0.087 | −2.633 | 0.000 |
| 0.030 | −2.635 | 0.000 |

TABLE 1-continued

| X | Y | Z |
|---|---|---|
| −0.031 | −2.634 | 0.000 |
| −0.096 | −2.628 | 0.000 |
| −0.161 | −2.619 | 0.000 |
| −0.228 | −2.606 | 0.000 |
| −0.297 | −2.588 | 0.000 |
| −0.369 | −2.565 | 0.000 |
| −0.447 | −2.535 | 0.000 |
| −0.534 | −2.496 | 0.000 |
| −0.631 | −2.448 | 0.000 |
| −0.737 | −2.387 | 0.000 |
| −0.853 | −2.315 | 0.000 |
| −0.975 | −2.230 | 0.000 |
| −1.096 | −2.138 | 0.000 |
| −1.219 | −2.036 | 0.000 |
| −1.342 | −1.925 | 0.000 |
| −1.342 | −1.925 | 0.000 |
| −1.399 | −1.871 | 0.000 |
| −1.452 | −1.819 | 0.000 |
| −1.501 | −1.769 | 0.000 |
| −1.544 | −1.719 | 0.000 |
| −1.580 | −1.670 | 0.000 |
| −1.612 | −1.619 | 0.000 |
| −1.640 | −1.565 | 0.000 |
| −1.662 | −1.510 | 0.000 |
| −1.679 | −1.455 | 0.000 |
| −1.690 | −1.402 | 0.000 |
| −1.696 | −1.349 | 0.000 |
| −1.697 | −1.297 | 0.000 |
| −1.694 | −1.246 | 0.000 |
| −1.685 | −1.194 | 0.000 |
| −1.672 | −1.143 | 0.000 |
| −1.654 | −1.090 | 0.000 |
| −1.630 | −1.039 | 0.000 |
| −1.601 | −0.989 | 0.000 |
| −1.567 | −0.938 | 0.000 |
| −1.527 | −0.887 | 0.000 |
| −1.480 | −0.836 | 0.000 |
| −1.426 | −0.785 | 0.000 |
| −1.370 | −0.738 | 0.000 |
| −1.311 | −0.695 | 0.000 |
| −1.250 | −0.656 | 0.000 |
| −1.185 | −0.620 | 0.000 |
| −1.116 | −0.585 | 0.000 |
| −1.042 | −0.552 | 0.000 |
| −0.965 | −0.519 | 0.000 |
| −0.886 | −0.486 | 0.000 |
| −0.803 | −0.450 | 0.000 |
| −0.716 | −0.411 | 0.000 |
| −0.716 | −0.411 | 0.000 |
| −0.612 | −0.361 | 0.000 |
| −0.509 | −0.309 | 0.000 |
| −0.407 | −0.253 | 0.000 |
| −0.308 | −0.195 | 0.000 |
| −0.213 | −0.134 | 0.000 |
| −0.121 | −0.073 | 0.000 |
| −0.032 | −0.010 | 0.000 |
| 0.054 | 0.055 | 0.000 |
| 0.138 | 0.121 | 0.000 |
| 0.221 | 0.189 | 0.000 |
| 0.303 | 0.259 | 0.000 |
| 0.383 | 0.331 | 0.000 |
| 0.461 | 0.405 | 0.000 |
| 0.538 | 0.480 | 0.000 |
| 0.614 | 0.557 | 0.000 |
| 0.688 | 0.634 | 0.000 |
| 0.762 | 0.716 | 0.000 |
| 0.840 | 0.803 | 0.000 |
| 0.924 | 0.902 | 0.000 |
| 1.017 | 1.014 | 0.000 |
| 1.122 | 1.147 | 0.000 |
| 1.179 | 1.223 | 0.000 |
| 1.240 | 1.305 | 0.000 |
| 1.367 | 1.484 | 0.000 |
| 1.430 | 1.577 | 0.000 |
| 1.492 | 1.672 | 0.000 |
| 1.612 | 1.862 | 0.000 |
| 1.730 | 2.056 | 0.000 |
| 1.846 | 2.256 | 0.000 |

TABLE 1-continued

| X | Y | Z |
|---|---|---|
| 1.961 | 2.461 | 0.000 |
| 2.072 | 2.670 | 0.000 |
| 2.181 | 2.881 | 0.000 |
| 2.286 | 3.096 | 0.000 |
| 2.388 | 3.314 | 0.000 |
| 2.488 | 3.536 | 0.000 |
| 2.488 | 3.536 | 0.000 |
| 2.527 | 3.629 | 0.000 |
| 2.565 | 3.722 | 0.000 |
| 2.601 | 3.817 | 0.000 |
| 2.636 | 3.911 | 0.000 |
| 2.670 | 4.005 | 0.000 |
| 2.704 | 4.099 | 0.000 |
| 2.739 | 4.193 | 0.000 |
| 2.775 | 4.287 | 0.000 |
| 2.754 | 4.358 | 0.086 |
| 2.819 | 4.532 | 0.086 |
| 2.886 | 4.717 | 0.086 |
| 2.954 | 4.915 | 0.086 |
| 2.954 | 4.915 | 0.086 |
| 2.955 | 4.917 | 0.086 |
| 2.957 | 4.919 | 0.086 |
| 2.959 | 4.920 | 0.086 |
| 2.961 | 4.921 | 0.086 |
| 2.964 | 4.921 | 0.086 |
| 2.966 | 4.921 | 0.086 |
| 2.966 | 4.921 | 0.086 |
| 3.012 | 4.909 | 0.086 |
| 3.012 | 4.909 | 0.086 |
| 3.014 | 4.908 | 0.086 |
| 3.016 | 4.906 | 0.086 |
| 3.017 | 4.905 | 0.086 |
| 3.018 | 4.902 | 0.086 |
| 3.019 | 4.900 | 0.086 |
| 3.019 | 4.898 | 0.086 |
| 3.019 | 4.898 | 0.086 |
| 2.965 | 4.533 | 0.086 |
| 2.899 | 4.164 | 0.086 |
| 2.899 | 4.164 | 0.086 |
| 2.849 | 3.923 | 0.086 |
| 2.822 | 3.794 | 0.086 |
| 2.794 | 3.661 | 0.086 |
| 2.763 | 3.521 | 0.086 |
| 2.731 | 3.376 | 0.086 |
| 2.697 | 3.226 | 0.086 |
| 2.662 | 3.075 | 0.086 |
| 2.513 | 2.453 | 0.086 |
| 2.477 | 2.304 | 0.086 |
| 2.440 | 2.158 | 0.086 |
| 2.369 | 1.879 | 0.086 |
| 2.301 | 1.621 | 0.086 |
| 2.237 | 1.379 | 0.086 |
| 2.175 | 1.151 | 0.086 |
| 2.115 | 0.937 | 0.086 |
| 2.058 | 0.734 | 0.086 |
| 2.002 | 0.544 | 0.086 |
| 1.898 | 0.199 | 0.086 |
| 1.846 | 0.034 | 0.086 |
| 1.794 | −0.126 | 0.086 |
| 1.689 | −0.433 | 0.086 |
| 1.640 | −0.572 | 0.086 |
| 1.592 | −0.702 | 0.086 |
| 1.499 | −0.937 | 0.086 |
| 1.456 | −1.043 | 0.086 |
| 1.413 | −1.142 | 0.086 |
| 1.372 | −1.235 | 0.086 |
| 1.331 | −1.325 | 0.086 |
| 1.287 | −1.416 | 0.086 |
| 1.243 | −1.505 | 0.086 |
| 1.155 | −1.671 | 0.086 |
| 1.072 | −1.814 | 0.086 |
| 0.995 | −1.934 | 0.086 |
| 0.924 | −2.037 | 0.086 |
| 0.857 | −2.124 | 0.086 |
| 0.793 | −2.200 | 0.086 |
| 0.733 | −2.265 | 0.086 |
| 0.674 | −2.322 | 0.086 |
| 0.617 | −2.373 | 0.086 |

TABLE 1-continued

| X | Y | Z |
|---|---|---|
| 0.559 | −2.419 | 0.086 |
| 0.503 | −2.459 | 0.086 |
| 0.449 | −2.494 | 0.086 |
| 0.397 | −2.523 | 0.086 |
| 0.347 | −2.548 | 0.086 |
| 0.300 | −2.568 | 0.086 |
| 0.254 | −2.584 | 0.086 |
| 0.208 | −2.598 | 0.086 |
| 0.160 | −2.608 | 0.086 |
| 0.109 | −2.617 | 0.086 |
| 0.057 | −2.622 | 0.086 |
| 0.001 | −2.625 | 0.086 |
| −0.057 | −2.625 | 0.086 |
| −0.116 | −2.621 | 0.086 |
| −0.177 | −2.614 | 0.086 |
| −0.238 | −2.603 | 0.086 |
| −0.302 | −2.588 | 0.086 |
| −0.369 | −2.569 | 0.086 |
| −0.442 | −2.544 | 0.086 |
| −0.523 | −2.511 | 0.086 |
| −0.612 | −2.470 | 0.086 |
| −0.709 | −2.420 | 0.086 |
| −0.814 | −2.360 | 0.086 |
| −0.926 | −2.290 | 0.086 |
| −1.040 | −2.211 | 0.086 |
| −1.155 | −2.125 | 0.086 |
| −1.271 | −2.029 | 0.086 |
| −1.389 | −1.925 | 0.086 |
| −1.389 | −1.925 | 0.086 |
| −1.445 | −1.873 | 0.086 |
| −1.498 | −1.823 | 0.086 |
| −1.546 | −1.774 | 0.086 |
| −1.589 | −1.726 | 0.086 |
| −1.626 | −1.678 | 0.086 |
| −1.659 | −1.628 | 0.086 |
| −1.687 | −1.576 | 0.086 |
| −1.710 | −1.523 | 0.086 |
| −1.728 | −1.469 | 0.086 |
| −1.741 | −1.417 | 0.086 |
| −1.749 | −1.366 | 0.086 |
| −1.752 | −1.316 | 0.086 |
| −1.750 | −1.267 | 0.086 |
| −1.744 | −1.218 | 0.086 |
| −1.734 | −1.169 | 0.086 |
| −1.718 | −1.120 | 0.086 |
| −1.697 | −1.069 | 0.086 |
| −1.670 | −1.015 | 0.086 |
| −1.637 | −0.962 | 0.086 |
| −1.600 | −0.912 | 0.086 |
| −1.559 | −0.864 | 0.086 |
| −1.514 | −0.817 | 0.086 |
| −1.464 | −0.770 | 0.086 |
| −1.410 | −0.726 | 0.086 |
| −1.353 | −0.684 | 0.086 |
| −1.293 | −0.645 | 0.086 |
| −1.228 | −0.607 | 0.086 |
| −1.159 | −0.572 | 0.086 |
| −1.087 | −0.538 | 0.086 |
| −1.011 | −0.504 | 0.086 |
| −0.933 | −0.470 | 0.086 |
| −0.852 | −0.433 | 0.086 |
| −0.767 | −0.394 | 0.086 |
| −0.767 | −0.394 | 0.086 |
| −0.662 | −0.341 | 0.086 |
| −0.556 | −0.285 | 0.086 |
| −0.452 | −0.227 | 0.086 |
| −0.351 | −0.166 | 0.086 |
| −0.252 | −0.103 | 0.086 |
| −0.148 | −0.031 | 0.086 |
| −0.032 | 0.053 | 0.086 |
| 0.099 | 0.156 | 0.086 |
| 0.240 | 0.275 | 0.086 |
| 0.385 | 0.407 | 0.086 |
| 0.533 | 0.551 | 0.086 |
| 0.685 | 0.711 | 0.086 |
| 0.839 | 0.883 | 0.086 |
| 0.989 | 1.063 | 0.086 |
| 1.132 | 1.247 | 0.086 |

TABLE 1-continued

| X | Y | Z |
|---|---|---|
| 1.270 | 1.436 | 0.086 |
| 1.404 | 1.630 | 0.086 |
| 1.533 | 1.828 | 0.086 |
| 1.658 | 2.029 | 0.086 |
| 1.778 | 2.233 | 0.086 |
| 1.899 | 2.447 | 0.086 |
| 2.025 | 2.681 | 0.086 |
| 2.161 | 2.946 | 0.086 |
| 2.308 | 3.251 | 0.086 |
| 2.469 | 3.607 | 0.086 |
| 2.469 | 3.607 | 0.086 |
| 2.508 | 3.700 | 0.086 |
| 2.545 | 3.793 | 0.086 |
| 2.581 | 3.888 | 0.086 |
| 2.616 | 3.982 | 0.086 |
| 2.650 | 4.076 | 0.086 |
| 2.684 | 4.170 | 0.086 |
| 2.718 | 4.264 | 0.086 |
| 2.754 | 4.358 | 0.086 |
| 2.733 | 4.429 | 0.171 |
| 2.934 | 4.985 | 0.171 |
| 2.934 | 4.985 | 0.171 |
| 2.935 | 4.988 | 0.171 |
| 2.937 | 4.990 | 0.171 |
| 2.939 | 4.991 | 0.171 |
| 2.941 | 4.992 | 0.171 |
| 2.944 | 4.992 | 0.171 |
| 2.946 | 4.992 | 0.171 |
| 2.946 | 4.992 | 0.171 |
| 2.991 | 4.980 | 0.171 |
| 2.991 | 4.980 | 0.171 |
| 2.993 | 4.979 | 0.171 |
| 2.995 | 4.977 | 0.171 |
| 2.997 | 4.976 | 0.171 |
| 2.998 | 4.973 | 0.171 |
| 2.998 | 4.971 | 0.171 |
| 2.998 | 4.968 | 0.171 |
| 2.998 | 4.968 | 0.171 |
| 2.943 | 4.604 | 0.171 |
| 2.880 | 4.235 | 0.171 |
| 2.880 | 4.235 | 0.171 |
| 2.744 | 3.590 | 0.171 |
| 2.597 | 2.946 | 0.171 |
| 2.443 | 2.309 | 0.171 |
| 2.282 | 1.678 | 0.171 |
| 2.113 | 1.050 | 0.171 |
| 2.025 | 0.736 | 0.171 |
| 1.934 | 0.426 | 0.171 |
| 1.841 | 0.120 | 0.171 |
| 1.744 | −0.179 | 0.171 |
| 1.643 | −0.473 | 0.171 |
| 1.535 | −0.763 | 0.171 |
| 1.422 | −1.045 | 0.171 |
| 1.303 | −1.313 | 0.171 |
| 1.176 | −1.567 | 0.171 |
| 1.107 | −1.691 | 0.171 |
| 1.035 | −1.811 | 0.171 |
| 0.880 | −2.040 | 0.171 |
| 0.716 | −2.237 | 0.171 |
| 0.542 | −2.395 | 0.171 |
| 0.348 | −2.517 | 0.171 |
| 0.244 | −2.561 | 0.171 |
| 0.137 | −2.590 | 0.171 |
| −0.080 | −2.610 | 0.171 |
| −0.187 | −2.604 | 0.171 |
| −0.294 | −2.586 | 0.171 |
| −0.402 | −2.558 | 0.171 |
| −0.514 | −2.519 | 0.171 |
| −0.628 | −2.471 | 0.171 |
| −0.744 | −2.414 | 0.171 |
| −0.861 | −2.350 | 0.171 |
| −0.977 | −2.278 | 0.171 |
| −1.093 | −2.200 | 0.171 |
| −1.207 | −2.115 | 0.171 |
| −1.322 | −2.024 | 0.171 |
| −1.436 | −1.924 | 0.171 |
| −1.436 | −1.924 | 0.171 |
| −1.559 | −1.813 | 0.171 |

TABLE 1-continued

| X | Y | Z |
|---|---|---|
| −1.656 | −1.708 | 0.171 |
| −1.726 | −1.604 | 0.171 |
| −1.773 | −1.499 | 0.171 |
| −1.789 | −1.445 | 0.171 |
| −1.800 | −1.391 | 0.171 |
| −1.807 | −1.282 | 0.171 |
| −1.791 | −1.174 | 0.171 |
| −1.754 | −1.068 | 0.171 |
| −1.696 | −0.965 | 0.171 |
| −1.660 | −0.915 | 0.171 |
| −1.619 | −0.865 | 0.171 |
| −1.526 | −0.772 | 0.171 |
| −1.418 | −0.686 | 0.171 |
| −1.293 | −0.607 | 0.171 |
| −1.148 | −0.532 | 0.171 |
| −0.987 | −0.457 | 0.171 |
| −0.819 | −0.376 | 0.171 |
| −0.819 | −0.376 | 0.171 |
| −0.518 | −0.211 | 0.171 |
| −0.377 | −0.123 | 0.171 |
| −0.242 | −0.033 | 0.171 |
| 0.011 | 0.158 | 0.171 |
| 0.132 | 0.258 | 0.171 |
| 0.250 | 0.363 | 0.171 |
| 0.366 | 0.472 | 0.171 |
| 0.480 | 0.584 | 0.171 |
| 0.591 | 0.700 | 0.171 |
| 0.700 | 0.818 | 0.171 |
| 0.910 | 1.064 | 0.171 |
| 1.111 | 1.321 | 0.171 |
| 1.304 | 1.590 | 0.171 |
| 1.490 | 1.869 | 0.171 |
| 1.667 | 2.154 | 0.171 |
| 1.835 | 2.444 | 0.171 |
| 1.995 | 2.741 | 0.171 |
| 2.151 | 3.046 | 0.171 |
| 2.446 | 3.678 | 0.171 |
| 2.446 | 3.678 | 0.171 |
| 2.593 | 4.051 | 0.171 |
| 2.733 | 4.429 | 0.171 |
| 2.712 | 4.500 | 0.257 |
| 2.778 | 4.672 | 0.257 |
| 2.846 | 4.857 | 0.257 |
| 2.916 | 5.055 | 0.257 |
| 2.916 | 5.055 | 0.257 |
| 2.917 | 5.058 | 0.257 |
| 2.919 | 5.060 | 0.257 |
| 2.921 | 5.061 | 0.257 |
| 2.923 | 5.062 | 0.257 |
| 2.925 | 5.062 | 0.257 |
| 2.928 | 5.062 | 0.257 |
| 2.928 | 5.062 | 0.257 |
| 2.973 | 5.050 | 0.257 |
| 2.973 | 5.050 | 0.257 |
| 2.975 | 5.049 | 0.257 |
| 2.977 | 5.048 | 0.257 |
| 2.979 | 5.046 | 0.257 |
| 2.980 | 5.044 | 0.257 |
| 2.980 | 5.041 | 0.257 |
| 2.980 | 5.039 | 0.257 |
| 2.980 | 5.039 | 0.257 |
| 2.924 | 4.675 | 0.257 |
| 2.862 | 4.305 | 0.257 |
| 2.862 | 4.305 | 0.257 |
| 2.812 | 4.058 | 0.257 |
| 2.756 | 3.793 | 0.257 |
| 2.694 | 3.511 | 0.257 |
| 2.661 | 3.364 | 0.257 |
| 2.626 | 3.213 | 0.257 |
| 2.590 | 3.057 | 0.257 |
| 2.552 | 2.895 | 0.257 |
| 2.513 | 2.732 | 0.257 |
| 2.474 | 2.573 | 0.257 |
| 2.436 | 2.418 | 0.257 |
| 2.398 | 2.263 | 0.257 |
| 2.360 | 2.112 | 0.257 |
| 2.322 | 1.967 | 0.257 |
| 2.251 | 1.692 | 0.257 |

TABLE 1-continued

| X | Y | Z |
|---|---|---|
| 2.183 | 1.434 | 0.257 |
| 2.117 | 1.190 | 0.257 |
| 2.054 | 0.962 | 0.257 |
| 1.934 | 0.544 | 0.257 |
| 1.824 | 0.180 | 0.257 |
| 1.771 | 0.010 | 0.257 |
| 1.717 | −0.153 | 0.257 |
| 1.613 | −0.455 | 0.257 |
| 1.564 | −0.592 | 0.257 |
| 1.515 | −0.719 | 0.257 |
| 1.424 | −0.949 | 0.257 |
| 1.379 | −1.056 | 0.257 |
| 1.334 | −1.160 | 0.257 |
| 1.241 | −1.362 | 0.257 |
| 1.196 | −1.452 | 0.257 |
| 1.152 | −1.536 | 0.257 |
| 1.108 | −1.617 | 0.257 |
| 1.064 | −1.693 | 0.257 |
| 0.978 | −1.832 | 0.257 |
| 0.899 | −1.951 | 0.257 |
| 0.825 | −2.051 | 0.257 |
| 0.757 | −2.136 | 0.257 |
| 0.694 | −2.207 | 0.257 |
| 0.635 | −2.267 | 0.257 |
| 0.578 | −2.320 | 0.257 |
| 0.520 | −2.367 | 0.257 |
| 0.463 | −2.409 | 0.257 |
| 0.407 | −2.446 | 0.257 |
| 0.352 | −2.478 | 0.257 |
| 0.299 | −2.505 | 0.257 |
| 0.247 | −2.527 | 0.257 |
| 0.196 | −2.545 | 0.257 |
| 0.144 | −2.561 | 0.257 |
| 0.091 | −2.573 | 0.257 |
| 0.035 | −2.583 | 0.257 |
| −0.023 | −2.589 | 0.257 |
| −0.083 | −2.592 | 0.257 |
| −0.144 | −2.592 | 0.257 |
| −0.206 | −2.588 | 0.257 |
| −0.270 | −2.580 | 0.257 |
| −0.338 | −2.568 | 0.257 |
| −0.409 | −2.551 | 0.257 |
| −0.487 | −2.528 | 0.257 |
| −0.570 | −2.499 | 0.257 |
| −0.660 | −2.463 | 0.257 |
| −0.758 | −2.417 | 0.257 |
| −0.865 | −2.361 | 0.257 |
| −0.982 | −2.294 | 0.257 |
| −1.103 | −2.216 | 0.257 |
| −1.228 | −2.129 | 0.257 |
| −1.355 | −2.031 | 0.257 |
| −1.485 | −1.923 | 0.257 |
| −1.485 | −1.923 | 0.257 |
| −1.543 | −1.872 | 0.257 |
| −1.598 | −1.823 | 0.257 |
| −1.647 | −1.775 | 0.257 |
| −1.691 | −1.728 | 0.257 |
| −1.730 | −1.681 | 0.257 |
| −1.763 | −1.633 | 0.257 |
| −1.792 | −1.583 | 0.257 |
| −1.816 | −1.531 | 0.257 |
| −1.835 | −1.479 | 0.257 |
| −1.849 | −1.427 | 0.257 |
| −1.858 | −1.376 | 0.257 |
| −1.862 | −1.325 | 0.257 |
| −1.862 | −1.274 | 0.257 |
| −1.858 | −1.224 | 0.257 |
| −1.848 | −1.174 | 0.257 |
| −1.834 | −1.123 | 0.257 |
| −1.815 | −1.072 | 0.257 |
| −1.791 | −1.022 | 0.257 |
| −1.762 | −0.972 | 0.257 |
| −1.727 | −0.921 | 0.257 |
| −1.685 | −0.869 | 0.257 |
| −1.636 | −0.817 | 0.257 |
| −1.582 | −0.766 | 0.257 |
| −1.525 | −0.719 | 0.257 |
| −1.467 | −0.675 | 0.257 |

TABLE 1-continued

| X | Y | Z |
|---|---|---|
| −1.406 | −0.635 | 0.257 |
| −1.341 | −0.596 | 0.257 |
| −1.271 | −0.558 | 0.257 |
| −1.197 | −0.521 | 0.257 |
| −1.120 | −0.484 | 0.257 |
| −1.041 | −0.445 | 0.257 |
| −0.958 | −0.404 | 0.257 |
| −0.872 | −0.359 | 0.257 |
| −0.872 | −0.359 | 0.257 |
| −0.769 | −0.302 | 0.257 |
| −0.666 | −0.243 | 0.257 |
| −0.565 | −0.182 | 0.257 |
| −0.465 | −0.119 | 0.257 |
| −0.368 | −0.054 | 0.257 |
| −0.274 | 0.012 | 0.257 |
| −0.183 | 0.080 | 0.257 |
| −0.094 | 0.150 | 0.257 |
| −0.006 | 0.221 | 0.257 |
| 0.080 | 0.295 | 0.257 |
| 0.164 | 0.370 | 0.257 |
| 0.246 | 0.446 | 0.257 |
| 0.328 | 0.525 | 0.257 |
| 0.415 | 0.611 | 0.257 |
| 0.511 | 0.711 | 0.257 |
| 0.619 | 0.828 | 0.257 |
| 0.736 | 0.961 | 0.257 |
| 0.858 | 1.106 | 0.257 |
| 0.985 | 1.266 | 0.257 |
| 1.118 | 1.442 | 0.257 |
| 1.255 | 1.634 | 0.257 |
| 1.390 | 1.833 | 0.257 |
| 1.520 | 2.035 | 0.257 |
| 1.645 | 2.239 | 0.257 |
| 1.766 | 2.445 | 0.257 |
| 1.883 | 2.655 | 0.257 |
| 1.996 | 2.867 | 0.257 |
| 2.106 | 3.083 | 0.257 |
| 2.213 | 3.301 | 0.257 |
| 2.318 | 3.523 | 0.257 |
| 2.421 | 3.749 | 0.257 |
| 2.421 | 3.749 | 0.257 |
| 2.570 | 4.122 | 0.257 |
| 2.712 | 4.500 | 0.257 |
| 2.693 | 4.569 | 0.342 |
| 2.760 | 4.742 | 0.342 |
| 2.829 | 4.926 | 0.342 |
| 2.900 | 5.124 | 0.342 |
| 2.900 | 5.124 | 0.342 |
| 2.902 | 5.127 | 0.342 |
| 2.903 | 5.128 | 0.342 |
| 2.905 | 5.130 | 0.342 |
| 2.907 | 5.131 | 0.342 |
| 2.910 | 5.131 | 0.342 |
| 2.912 | 5.131 | 0.342 |
| 2.912 | 5.131 | 0.342 |
| 2.958 | 5.119 | 0.342 |
| 2.958 | 5.119 | 0.342 |
| 2.960 | 5.118 | 0.342 |
| 2.962 | 5.117 | 0.342 |
| 2.964 | 5.115 | 0.342 |
| 2.965 | 5.113 | 0.342 |
| 2.965 | 5.110 | 0.342 |
| 2.965 | 5.108 | 0.342 |
| 2.965 | 5.108 | 0.342 |
| 2.909 | 4.745 | 0.342 |
| 2.847 | 4.375 | 0.342 |
| 2.847 | 4.375 | 0.342 |
| 2.786 | 4.076 | 0.342 |
| 2.752 | 3.918 | 0.342 |
| 2.717 | 3.755 | 0.342 |
| 2.679 | 3.584 | 0.342 |
| 2.639 | 3.406 | 0.342 |
| 2.597 | 3.225 | 0.342 |
| 2.555 | 3.046 | 0.342 |
| 2.513 | 2.867 | 0.342 |
| 2.469 | 2.687 | 0.342 |
| 2.425 | 2.509 | 0.342 |
| 2.383 | 2.338 | 0.342 |

TABLE 1-continued

| X | Y | Z |
|---|---|---|
| 2.342 | 2.175 | 0.342 |
| 2.301 | 2.018 | 0.342 |
| 2.223 | 1.717 | 0.342 |
| 2.148 | 1.434 | 0.342 |
| 2.075 | 1.169 | 0.342 |
| 2.006 | 0.919 | 0.342 |
| 1.939 | 0.684 | 0.342 |
| 1.812 | 0.260 | 0.342 |
| 1.749 | 0.062 | 0.342 |
| 1.688 | −0.126 | 0.342 |
| 1.569 | −0.470 | 0.342 |
| 1.511 | −0.625 | 0.342 |
| 1.456 | −0.769 | 0.342 |
| 1.350 | −1.028 | 0.342 |
| 1.247 | −1.259 | 0.342 |
| 1.150 | −1.456 | 0.342 |
| 1.056 | −1.629 | 0.342 |
| 0.964 | −1.780 | 0.342 |
| 0.879 | −1.909 | 0.342 |
| 0.801 | −2.017 | 0.342 |
| 0.728 | −2.108 | 0.342 |
| 0.660 | −2.184 | 0.342 |
| 0.597 | −2.248 | 0.342 |
| 0.536 | −2.303 | 0.342 |
| 0.474 | −2.353 | 0.342 |
| 0.413 | −2.397 | 0.342 |
| 0.352 | −2.435 | 0.342 |
| 0.293 | −2.467 | 0.342 |
| 0.236 | −2.494 | 0.342 |
| 0.180 | −2.516 | 0.342 |
| 0.124 | −2.535 | 0.342 |
| 0.067 | −2.549 | 0.342 |
| 0.009 | −2.560 | 0.342 |
| −0.051 | −2.568 | 0.342 |
| −0.114 | −2.572 | 0.342 |
| −0.180 | −2.572 | 0.342 |
| −0.249 | −2.568 | 0.342 |
| −0.321 | −2.559 | 0.342 |
| −0.399 | −2.545 | 0.342 |
| −0.480 | −2.526 | 0.342 |
| −0.565 | −2.501 | 0.342 |
| −0.654 | −2.469 | 0.342 |
| −0.751 | −2.428 | 0.342 |
| −0.859 | −2.376 | 0.342 |
| −0.980 | −2.311 | 0.342 |
| −1.111 | −2.231 | 0.342 |
| −1.249 | −2.140 | 0.342 |
| −1.390 | −2.036 | 0.342 |
| −1.534 | −1.921 | 0.342 |
| −1.534 | −1.921 | 0.342 |
| −1.593 | −1.871 | 0.342 |
| −1.649 | −1.822 | 0.342 |
| −1.699 | −1.775 | 0.342 |
| −1.744 | −1.728 | 0.342 |
| −1.783 | −1.682 | 0.342 |
| −1.816 | −1.634 | 0.342 |
| −1.845 | −1.585 | 0.342 |
| −1.870 | −1.534 | 0.342 |
| −1.889 | −1.483 | 0.342 |
| −1.904 | −1.431 | 0.342 |
| −1.913 | −1.379 | 0.342 |
| −1.919 | −1.328 | 0.342 |
| −1.919 | −1.276 | 0.342 |
| −1.915 | −1.224 | 0.342 |
| −1.906 | −1.173 | 0.342 |
| −1.893 | −1.121 | 0.342 |
| −1.874 | −1.069 | 0.342 |
| −1.851 | −1.019 | 0.342 |
| −1.823 | −0.968 | 0.342 |
| −1.788 | −0.917 | 0.342 |
| −1.747 | −0.865 | 0.342 |
| −1.697 | −0.812 | 0.342 |
| −1.642 | −0.761 | 0.342 |
| −1.585 | −0.714 | 0.342 |
| −1.526 | −0.671 | 0.342 |
| −1.464 | −0.631 | 0.342 |
| −1.399 | −0.592 | 0.342 |
| −1.329 | −0.553 | 0.342 |

TABLE 1-continued

| X | Y | Z |
|---|---|---|
| −1.255 | −0.514 | 0.342 |
| −1.177 | −0.474 | 0.342 |
| −1.097 | −0.433 | 0.342 |
| −1.013 | −0.390 | 0.342 |
| −0.927 | −0.343 | 0.342 |
| −0.927 | −0.343 | 0.342 |
| −0.821 | −0.281 | 0.342 |
| −0.717 | −0.218 | 0.342 |
| −0.614 | −0.153 | 0.342 |
| −0.512 | −0.086 | 0.342 |
| −0.411 | −0.017 | 0.342 |
| −0.312 | 0.056 | 0.342 |
| −0.215 | 0.130 | 0.342 |
| −0.120 | 0.206 | 0.342 |
| −0.026 | 0.287 | 0.342 |
| 0.073 | 0.375 | 0.342 |
| 0.181 | 0.475 | 0.342 |
| 0.301 | 0.592 | 0.342 |
| 0.368 | 0.660 | 0.342 |
| 0.438 | 0.733 | 0.342 |
| 0.514 | 0.815 | 0.342 |
| 0.593 | 0.901 | 0.342 |
| 0.752 | 1.086 | 0.342 |
| 0.828 | 1.179 | 0.342 |
| 0.903 | 1.273 | 0.342 |
| 1.049 | 1.463 | 0.342 |
| 1.190 | 1.658 | 0.342 |
| 1.327 | 1.859 | 0.342 |
| 1.461 | 2.064 | 0.342 |
| 1.591 | 2.272 | 0.342 |
| 1.716 | 2.483 | 0.342 |
| 1.837 | 2.698 | 0.342 |
| 1.955 | 2.916 | 0.342 |
| 2.070 | 3.137 | 0.342 |
| 2.181 | 3.360 | 0.342 |
| 2.290 | 3.588 | 0.342 |
| 2.397 | 3.819 | 0.342 |
| 2.397 | 3.819 | 0.342 |
| 2.437 | 3.911 | 0.342 |
| 2.476 | 4.005 | 0.342 |
| 2.513 | 4.100 | 0.342 |
| 2.549 | 4.194 | 0.342 |
| 2.585 | 4.288 | 0.342 |
| 2.620 | 4.382 | 0.342 |
| 2.656 | 4.476 | 0.342 |
| 2.693 | 4.569 | 0.342 |
| 2.677 | 4.637 | 0.428 |
| 2.746 | 4.809 | 0.428 |
| 2.816 | 4.994 | 0.428 |
| 2.889 | 5.192 | 0.428 |
| 2.889 | 5.192 | 0.428 |
| 2.890 | 5.194 | 0.428 |
| 2.892 | 5.196 | 0.428 |
| 2.894 | 5.197 | 0.428 |
| 2.896 | 5.198 | 0.428 |
| 2.898 | 5.198 | 0.428 |
| 2.901 | 5.198 | 0.428 |
| 2.901 | 5.198 | 0.428 |
| 2.946 | 5.187 | 0.428 |
| 2.946 | 5.187 | 0.428 |
| 2.948 | 5.186 | 0.428 |
| 2.950 | 5.184 | 0.428 |
| 2.952 | 5.182 | 0.428 |
| 2.953 | 5.180 | 0.428 |
| 2.954 | 5.178 | 0.428 |
| 2.953 | 5.175 | 0.428 |
| 2.953 | 5.175 | 0.428 |
| 2.898 | 4.813 | 0.428 |
| 2.834 | 4.443 | 0.428 |
| 2.834 | 4.443 | 0.428 |
| 2.770 | 4.131 | 0.428 |
| 2.737 | 3.977 | 0.428 |
| 2.704 | 3.824 | 0.428 |
| 2.671 | 3.675 | 0.428 |
| 2.637 | 3.527 | 0.428 |
| 2.568 | 3.226 | 0.428 |
| 2.491 | 2.904 | 0.428 |
| 2.450 | 2.738 | 0.428 |

TABLE 1-continued

| X | Y | Z |
|---|---|---|
| 2.409 | 2.572 | 0.428 |
| 2.367 | 2.404 | 0.428 |
| 2.323 | 2.234 | 0.428 |
| 2.280 | 2.065 | 0.428 |
| 2.237 | 1.900 | 0.428 |
| 2.195 | 1.741 | 0.428 |
| 2.153 | 1.584 | 0.428 |
| 2.071 | 1.284 | 0.428 |
| 1.993 | 1.005 | 0.428 |
| 1.918 | 0.743 | 0.428 |
| 1.776 | 0.271 | 0.428 |
| 1.642 | −0.142 | 0.428 |
| 1.516 | −0.499 | 0.428 |
| 1.398 | −0.808 | 0.428 |
| 1.286 | −1.074 | 0.428 |
| 1.180 | −1.302 | 0.428 |
| 1.081 | −1.496 | 0.428 |
| 0.986 | −1.664 | 0.428 |
| 0.896 | −1.808 | 0.428 |
| 0.811 | −1.931 | 0.428 |
| 0.733 | −2.034 | 0.428 |
| 0.660 | −2.120 | 0.428 |
| 0.593 | −2.191 | 0.428 |
| 0.529 | −2.252 | 0.428 |
| 0.466 | −2.305 | 0.428 |
| 0.403 | −2.353 | 0.428 |
| 0.340 | −2.395 | 0.428 |
| 0.278 | −2.431 | 0.428 |
| 0.217 | −2.462 | 0.428 |
| 0.158 | −2.487 | 0.428 |
| 0.101 | −2.508 | 0.428 |
| 0.044 | −2.524 | 0.428 |
| −0.013 | −2.537 | 0.428 |
| −0.072 | −2.545 | 0.428 |
| −0.134 | −2.551 | 0.428 |
| −0.200 | −2.552 | 0.428 |
| −0.271 | −2.549 | 0.428 |
| −0.348 | −2.542 | 0.428 |
| −0.430 | −2.529 | 0.428 |
| −0.514 | −2.511 | 0.428 |
| −0.599 | −2.488 | 0.428 |
| −0.688 | −2.458 | 0.428 |
| −0.783 | −2.420 | 0.428 |
| −0.888 | −2.372 | 0.428 |
| −1.007 | −2.310 | 0.428 |
| −1.139 | −2.233 | 0.428 |
| −1.284 | −2.141 | 0.428 |
| −1.433 | −2.035 | 0.428 |
| −1.584 | −1.918 | 0.428 |
| −1.584 | −1.918 | 0.428 |
| −1.645 | −1.868 | 0.428 |
| −1.702 | −1.820 | 0.428 |
| −1.754 | −1.772 | 0.428 |
| −1.800 | −1.725 | 0.428 |
| −1.839 | −1.678 | 0.428 |
| −1.873 | −1.630 | 0.428 |
| −1.903 | −1.581 | 0.428 |
| −1.927 | −1.529 | 0.428 |
| −1.947 | −1.477 | 0.428 |
| −1.961 | −1.425 | 0.428 |
| −1.971 | −1.372 | 0.428 |
| −1.976 | −1.318 | 0.428 |
| −1.976 | −1.264 | 0.428 |
| −1.971 | −1.211 | 0.428 |
| −1.962 | −1.157 | 0.428 |
| −1.948 | −1.104 | 0.428 |
| −1.928 | −1.051 | 0.428 |
| −1.903 | −0.999 | 0.428 |
| −1.874 | −0.949 | 0.428 |
| −1.841 | −0.901 | 0.428 |
| −1.802 | −0.854 | 0.428 |
| −1.757 | −0.807 | 0.428 |
| −1.707 | −0.761 | 0.428 |
| −1.652 | −0.716 | 0.428 |
| −1.594 | −0.673 | 0.428 |
| −1.531 | −0.632 | 0.428 |
| −1.465 | −0.591 | 0.428 |
| −1.393 | −0.550 | 0.428 |

TABLE 1-continued

| X | Y | Z |
|---|---|---|
| −1.318 | −0.509 | 0.428 |
| −1.238 | −0.467 | 0.428 |
| −1.156 | −0.423 | 0.428 |
| −1.071 | −0.376 | 0.428 |
| −0.983 | −0.326 | 0.428 |
| −0.983 | −0.326 | 0.428 |
| −0.877 | −0.262 | 0.428 |
| −0.772 | −0.196 | 0.428 |
| −0.669 | −0.129 | 0.428 |
| −0.567 | −0.059 | 0.428 |
| −0.466 | 0.013 | 0.428 |
| −0.367 | 0.087 | 0.428 |
| −0.269 | 0.163 | 0.428 |
| −0.174 | 0.242 | 0.428 |
| −0.079 | 0.323 | 0.428 |
| 0.021 | 0.413 | 0.428 |
| 0.129 | 0.515 | 0.428 |
| 0.249 | 0.634 | 0.428 |
| 0.316 | 0.702 | 0.428 |
| 0.386 | 0.776 | 0.428 |
| 0.462 | 0.858 | 0.428 |
| 0.540 | 0.945 | 0.428 |
| 0.700 | 1.130 | 0.428 |
| 0.778 | 1.224 | 0.428 |
| 0.853 | 1.319 | 0.428 |
| 1.000 | 1.510 | 0.428 |
| 1.143 | 1.706 | 0.428 |
| 1.281 | 1.906 | 0.428 |
| 1.416 | 2.110 | 0.428 |
| 1.546 | 2.319 | 0.428 |
| 1.674 | 2.532 | 0.428 |
| 1.800 | 2.751 | 0.428 |
| 1.923 | 2.975 | 0.428 |
| 2.042 | 3.201 | 0.428 |
| 2.157 | 3.428 | 0.428 |
| 2.268 | 3.657 | 0.428 |
| 2.377 | 3.888 | 0.428 |
| 2.377 | 3.888 | 0.428 |
| 2.418 | 3.981 | 0.428 |
| 2.457 | 4.074 | 0.428 |
| 2.495 | 4.169 | 0.428 |
| 2.532 | 4.263 | 0.428 |
| 2.568 | 4.357 | 0.428 |
| 2.603 | 4.450 | 0.428 |
| 2.640 | 4.544 | 0.428 |
| 2.677 | 4.637 | 0.428 |
| 2.667 | 4.703 | 0.513 |
| 2.737 | 4.875 | 0.513 |
| 2.808 | 5.060 | 0.513 |
| 2.882 | 5.257 | 0.513 |
| 2.882 | 5.257 | 0.513 |
| 2.883 | 5.259 | 0.513 |
| 2.885 | 5.261 | 0.513 |
| 2.887 | 5.262 | 0.513 |
| 2.889 | 5.263 | 0.513 |
| 2.891 | 5.263 | 0.513 |
| 2.894 | 5.263 | 0.513 |
| 2.894 | 5.263 | 0.513 |
| 2.939 | 5.251 | 0.513 |
| 2.939 | 5.251 | 0.513 |
| 2.941 | 5.251 | 0.513 |
| 2.943 | 5.249 | 0.513 |
| 2.945 | 5.247 | 0.513 |
| 2.946 | 5.245 | 0.513 |
| 2.947 | 5.243 | 0.513 |
| 2.946 | 5.240 | 0.513 |
| 2.946 | 5.240 | 0.513 |
| 2.905 | 4.972 | 0.513 |
| 2.866 | 4.728 | 0.513 |
| 2.825 | 4.508 | 0.513 |
| 2.825 | 4.508 | 0.513 |
| 2.798 | 4.376 | 0.513 |
| 2.770 | 4.243 | 0.513 |
| 2.741 | 4.111 | 0.513 |
| 2.713 | 3.979 | 0.513 |
| 2.683 | 3.847 | 0.513 |
| 2.652 | 3.709 | 0.513 |
| 2.618 | 3.561 | 0.513 |

TABLE 1-continued

| X | Y | Z |
|---|---|---|
| 2.580 | 3.396 | 0.513 |
| 2.536 | 3.213 | 0.513 |
| 2.488 | 3.013 | 0.513 |
| 2.434 | 2.793 | 0.513 |
| 2.372 | 2.550 | 0.513 |
| 2.303 | 2.281 | 0.513 |
| 2.225 | 1.983 | 0.513 |
| 2.182 | 1.820 | 0.513 |
| 2.135 | 1.647 | 0.513 |
| 2.084 | 1.459 | 0.513 |
| 2.057 | 1.361 | 0.513 |
| 2.029 | 1.262 | 0.513 |
| 1.912 | 0.852 | 0.513 |
| 1.883 | 0.752 | 0.513 |
| 1.854 | 0.653 | 0.513 |
| 1.796 | 0.463 | 0.513 |
| 1.742 | 0.288 | 0.513 |
| 1.689 | 0.123 | 0.513 |
| 1.588 | −0.180 | 0.513 |
| 1.492 | −0.450 | 0.513 |
| 1.400 | −0.691 | 0.513 |
| 1.313 | −0.904 | 0.513 |
| 1.230 | −1.094 | 0.513 |
| 1.151 | −1.264 | 0.513 |
| 1.075 | −1.415 | 0.513 |
| 1.003 | −1.547 | 0.513 |
| 0.936 | −1.662 | 0.513 |
| 0.873 | −1.763 | 0.513 |
| 0.812 | −1.853 | 0.513 |
| 0.751 | −1.937 | 0.513 |
| 0.688 | −2.018 | 0.513 |
| 0.621 | −2.095 | 0.513 |
| 0.552 | −2.169 | 0.513 |
| 0.481 | −2.235 | 0.513 |
| 0.410 | −2.295 | 0.513 |
| 0.336 | −2.349 | 0.513 |
| 0.257 | −2.397 | 0.513 |
| 0.178 | −2.439 | 0.513 |
| 0.103 | −2.471 | 0.513 |
| 0.031 | −2.496 | 0.513 |
| −0.041 | −2.513 | 0.513 |
| −0.115 | −2.526 | 0.513 |
| −0.196 | −2.532 | 0.513 |
| −0.282 | −2.532 | 0.513 |
| −0.372 | −2.526 | 0.513 |
| −0.465 | −2.514 | 0.513 |
| −0.560 | −2.495 | 0.513 |
| −0.657 | −2.469 | 0.513 |
| −0.754 | −2.437 | 0.513 |
| −0.850 | −2.399 | 0.513 |
| −0.945 | −2.356 | 0.513 |
| −1.041 | −2.307 | 0.513 |
| −1.138 | −2.254 | 0.513 |
| −1.236 | −2.195 | 0.513 |
| −1.335 | −2.132 | 0.513 |
| −1.435 | −2.064 | 0.513 |
| −1.535 | −1.992 | 0.513 |
| −1.635 | −1.915 | 0.513 |
| −1.635 | −1.915 | 0.513 |
| −1.697 | −1.866 | 0.513 |
| −1.754 | −1.819 | 0.513 |
| −1.806 | −1.772 | 0.513 |
| −1.852 | −1.726 | 0.513 |
| −1.892 | −1.680 | 0.513 |
| −1.926 | −1.633 | 0.513 |
| −1.956 | −1.584 | 0.513 |
| −1.981 | −1.533 | 0.513 |
| −2.002 | −1.482 | 0.513 |
| −2.017 | −1.430 | 0.513 |
| −2.028 | −1.377 | 0.513 |
| −2.033 | −1.324 | 0.513 |
| −2.035 | −1.270 | 0.513 |
| −2.031 | −1.216 | 0.513 |
| −2.023 | −1.163 | 0.513 |
| −2.010 | −1.111 | 0.513 |
| −1.992 | −1.059 | 0.513 |
| −1.970 | −1.008 | 0.513 |
| −1.942 | −0.959 | 0.513 |

TABLE 1-continued

| X | Y | Z |
|---|---|---|
| −1.911 | −0.912 | 0.513 |
| −1.875 | −0.866 | 0.513 |
| −1.833 | −0.819 | 0.513 |
| −1.784 | −0.773 | 0.513 |
| −1.731 | −0.728 | 0.513 |
| −1.674 | −0.685 | 0.513 |
| −1.614 | −0.643 | 0.513 |
| −1.550 | −0.602 | 0.513 |
| −1.478 | −0.559 | 0.513 |
| −1.399 | −0.514 | 0.513 |
| −1.311 | −0.465 | 0.513 |
| −1.219 | −0.414 | 0.513 |
| −1.126 | −0.361 | 0.513 |
| −1.038 | −0.308 | 0.513 |
| −1.038 | −0.308 | 0.513 |
| −0.931 | −0.241 | 0.513 |
| −0.824 | −0.171 | 0.513 |
| −0.718 | −0.100 | 0.513 |
| −0.614 | −0.026 | 0.513 |
| −0.511 | 0.049 | 0.513 |
| −0.408 | 0.128 | 0.513 |
| −0.308 | 0.208 | 0.513 |
| −0.215 | 0.285 | 0.513 |
| −0.130 | 0.359 | 0.513 |
| −0.049 | 0.433 | 0.513 |
| 0.033 | 0.509 | 0.513 |
| 0.116 | 0.590 | 0.513 |
| 0.201 | 0.675 | 0.513 |
| 0.284 | 0.761 | 0.513 |
| 0.365 | 0.848 | 0.513 |
| 0.446 | 0.935 | 0.513 |
| 0.529 | 1.029 | 0.513 |
| 0.617 | 1.131 | 0.513 |
| 0.715 | 1.248 | 0.513 |
| 0.824 | 1.383 | 0.513 |
| 0.885 | 1.461 | 0.513 |
| 0.949 | 1.544 | 0.513 |
| 1.088 | 1.733 | 0.513 |
| 1.160 | 1.834 | 0.513 |
| 1.231 | 1.937 | 0.513 |
| 1.300 | 2.040 | 0.513 |
| 1.369 | 2.144 | 0.513 |
| 1.503 | 2.354 | 0.513 |
| 1.635 | 2.571 | 0.513 |
| 1.765 | 2.795 | 0.513 |
| 1.893 | 3.023 | 0.513 |
| 2.016 | 3.254 | 0.513 |
| 2.135 | 3.486 | 0.513 |
| 2.251 | 3.720 | 0.513 |
| 2.363 | 3.956 | 0.513 |
| 2.363 | 3.956 | 0.513 |
| 2.405 | 4.049 | 0.513 |
| 2.445 | 4.142 | 0.513 |
| 2.483 | 4.236 | 0.513 |
| 2.520 | 4.330 | 0.513 |
| 2.556 | 4.424 | 0.513 |
| 2.593 | 4.517 | 0.513 |
| 2.629 | 4.610 | 0.513 |
| 2.667 | 4.703 | 0.513 |
| 2.663 | 4.767 | 0.599 |
| 2.734 | 4.939 | 0.599 |
| 2.805 | 5.122 | 0.599 |
| 2.880 | 5.319 | 0.599 |
| 2.880 | 5.319 | 0.599 |
| 2.881 | 5.321 | 0.599 |
| 2.883 | 5.323 | 0.599 |
| 2.885 | 5.325 | 0.599 |
| 2.887 | 5.326 | 0.599 |
| 2.890 | 5.326 | 0.599 |
| 2.892 | 5.325 | 0.599 |
| 2.892 | 5.325 | 0.599 |
| 2.937 | 5.313 | 0.599 |
| 2.937 | 5.313 | 0.599 |
| 2.940 | 5.312 | 0.599 |
| 2.942 | 5.311 | 0.599 |
| 2.943 | 5.309 | 0.599 |
| 2.944 | 5.307 | 0.599 |
| 2.945 | 5.304 | 0.599 |

TABLE 1-continued

| X | Y | Z |
|---|---|---|
| 2.945 | 5.302 | 0.599 |
| 2.945 | 5.302 | 0.599 |
| 2.902 | 5.034 | 0.599 |
| 2.862 | 4.790 | 0.599 |
| 2.820 | 4.570 | 0.599 |
| 2.820 | 4.570 | 0.599 |
| 2.792 | 4.437 | 0.599 |
| 2.763 | 4.304 | 0.599 |
| 2.734 | 4.171 | 0.599 |
| 2.705 | 4.039 | 0.599 |
| 2.675 | 3.906 | 0.599 |
| 2.643 | 3.768 | 0.599 |
| 2.608 | 3.618 | 0.599 |
| 2.569 | 3.453 | 0.599 |
| 2.525 | 3.269 | 0.599 |
| 2.475 | 3.068 | 0.599 |
| 2.419 | 2.847 | 0.599 |
| 2.357 | 2.604 | 0.599 |
| 2.287 | 2.334 | 0.599 |
| 2.207 | 2.034 | 0.599 |
| 2.163 | 1.871 | 0.599 |
| 2.116 | 1.697 | 0.599 |
| 2.064 | 1.509 | 0.599 |
| 2.036 | 1.410 | 0.599 |
| 2.008 | 1.311 | 0.599 |
| 1.890 | 0.897 | 0.599 |
| 1.860 | 0.797 | 0.599 |
| 1.830 | 0.697 | 0.599 |
| 1.772 | 0.505 | 0.599 |
| 1.716 | 0.328 | 0.599 |
| 1.663 | 0.162 | 0.599 |
| 1.560 | −0.144 | 0.599 |
| 1.462 | −0.417 | 0.599 |
| 1.369 | −0.660 | 0.599 |
| 1.280 | −0.876 | 0.599 |
| 1.196 | −1.068 | 0.599 |
| 1.115 | −1.239 | 0.599 |
| 1.038 | −1.391 | 0.599 |
| 0.965 | −1.524 | 0.599 |
| 0.896 | −1.641 | 0.599 |
| 0.832 | −1.742 | 0.599 |
| 0.771 | −1.833 | 0.599 |
| 0.709 | −1.917 | 0.599 |
| 0.645 | −1.999 | 0.599 |
| 0.577 | −2.077 | 0.599 |
| 0.507 | −2.150 | 0.599 |
| 0.436 | −2.216 | 0.599 |
| 0.364 | −2.276 | 0.599 |
| 0.290 | −2.329 | 0.599 |
| 0.213 | −2.377 | 0.599 |
| 0.135 | −2.418 | 0.599 |
| 0.061 | −2.450 | 0.599 |
| −0.011 | −2.475 | 0.599 |
| −0.084 | −2.494 | 0.599 |
| −0.159 | −2.507 | 0.599 |
| −0.241 | −2.514 | 0.599 |
| −0.328 | −2.515 | 0.599 |
| −0.418 | −2.510 | 0.599 |
| −0.510 | −2.498 | 0.599 |
| −0.605 | −2.480 | 0.599 |
| −0.702 | −2.456 | 0.599 |
| −0.800 | −2.424 | 0.599 |
| −0.897 | −2.387 | 0.599 |
| −0.993 | −2.345 | 0.599 |
| −1.090 | −2.298 | 0.599 |
| −1.187 | −2.245 | 0.599 |
| −1.286 | −2.187 | 0.599 |
| −1.386 | −2.125 | 0.599 |
| −1.486 | −2.059 | 0.599 |
| −1.586 | −1.988 | 0.599 |
| −1.688 | −1.912 | 0.599 |
| −1.688 | −1.912 | 0.599 |
| −1.750 | −1.863 | 0.599 |
| −1.808 | −1.816 | 0.599 |
| −1.861 | −1.770 | 0.599 |
| −1.907 | −1.723 | 0.599 |
| −1.948 | −1.677 | 0.599 |
| −1.983 | −1.630 | 0.599 |

TABLE 1-continued

| X | Y | Z |
|---|---|---|
| −2.013 | −1.581 | 0.599 |
| −2.039 | −1.530 | 0.599 |
| −2.060 | −1.478 | 0.599 |
| −2.075 | −1.425 | 0.599 |
| −2.086 | −1.372 | 0.599 |
| −2.092 | −1.319 | 0.599 |
| −2.094 | −1.265 | 0.599 |
| −2.090 | −1.212 | 0.599 |
| −2.082 | −1.159 | 0.599 |
| −2.070 | −1.107 | 0.599 |
| −2.052 | −1.056 | 0.599 |
| −2.030 | −1.006 | 0.599 |
| −2.003 | −0.957 | 0.599 |
| −1.971 | −0.910 | 0.599 |
| −1.935 | −0.864 | 0.599 |
| −1.892 | −0.818 | 0.599 |
| −1.844 | −0.771 | 0.599 |
| −1.790 | −0.725 | 0.599 |
| −1.732 | −0.681 | 0.599 |
| −1.672 | −0.638 | 0.599 |
| −1.607 | −0.595 | 0.599 |
| −1.535 | −0.550 | 0.599 |
| −1.455 | −0.503 | 0.599 |
| −1.367 | −0.452 | 0.599 |
| −1.275 | −0.399 | 0.599 |
| −1.182 | −0.345 | 0.599 |
| −1.094 | −0.290 | 0.599 |
| −1.094 | −0.290 | 0.599 |
| −0.882 | −0.151 | 0.599 |
| −0.680 | −0.009 | 0.599 |
| −0.487 | 0.137 | 0.599 |
| −0.301 | 0.289 | 0.599 |
| −0.121 | 0.447 | 0.599 |
| 0.053 | 0.612 | 0.599 |
| 0.222 | 0.783 | 0.599 |
| 0.387 | 0.959 | 0.599 |
| 0.547 | 1.140 | 0.599 |
| 0.703 | 1.325 | 0.599 |
| 0.856 | 1.517 | 0.599 |
| 1.010 | 1.719 | 0.599 |
| 1.164 | 1.934 | 0.599 |
| 1.317 | 2.158 | 0.599 |
| 1.467 | 2.390 | 0.599 |
| 1.614 | 2.629 | 0.599 |
| 1.756 | 2.868 | 0.599 |
| 1.889 | 3.105 | 0.599 |
| 2.013 | 3.335 | 0.599 |
| 2.131 | 3.561 | 0.599 |
| 2.244 | 3.788 | 0.599 |
| 2.356 | 4.022 | 0.599 |
| 2.356 | 4.022 | 0.599 |
| 2.398 | 4.114 | 0.599 |
| 2.439 | 4.208 | 0.599 |
| 2.477 | 4.302 | 0.599 |
| 2.515 | 4.395 | 0.599 |
| 2.551 | 4.489 | 0.599 |
| 2.588 | 4.582 | 0.599 |
| 2.625 | 4.675 | 0.599 |
| 2.663 | 4.767 | 0.599 |
| 2.665 | 4.828 | 0.684 |
| 2.736 | 4.998 | 0.684 |
| 2.808 | 5.182 | 0.684 |
| 2.884 | 5.378 | 0.684 |
| 2.884 | 5.378 | 0.684 |
| 2.885 | 5.380 | 0.684 |
| 2.887 | 5.382 | 0.684 |
| 2.889 | 5.383 | 0.684 |
| 2.891 | 5.384 | 0.684 |
| 2.894 | 5.384 | 0.684 |
| 2.896 | 5.384 | 0.684 |
| 2.896 | 5.384 | 0.684 |
| 2.941 | 5.371 | 0.684 |
| 2.941 | 5.371 | 0.684 |
| 2.943 | 5.370 | 0.684 |
| 2.945 | 5.369 | 0.684 |
| 2.947 | 5.367 | 0.684 |
| 2.948 | 5.365 | 0.684 |
| 2.948 | 5.362 | 0.684 |

TABLE 1-continued

| X | Y | Z |
|---|---|---|
| 2.948 | 5.360 | 0.684 |
| 2.948 | 5.360 | 0.684 |
| 2.904 | 5.091 | 0.684 |
| 2.863 | 4.848 | 0.684 |
| 2.820 | 4.627 | 0.684 |
| 2.820 | 4.627 | 0.684 |
| 2.700 | 4.090 | 0.684 |
| 2.569 | 3.538 | 0.684 |
| 2.429 | 2.979 | 0.684 |
| 2.356 | 2.698 | 0.684 |
| 2.320 | 2.558 | 0.684 |
| 2.283 | 2.419 | 0.684 |
| 2.135 | 1.874 | 0.684 |
| 2.065 | 1.623 | 0.684 |
| 1.999 | 1.387 | 0.684 |
| 1.936 | 1.169 | 0.684 |
| 1.876 | 0.964 | 0.684 |
| 1.818 | 0.770 | 0.684 |
| 1.761 | 0.584 | 0.684 |
| 1.704 | 0.403 | 0.684 |
| 1.647 | 0.228 | 0.684 |
| 1.532 | −0.112 | 0.684 |
| 1.476 | −0.269 | 0.684 |
| 1.421 | −0.418 | 0.684 |
| 1.317 | −0.685 | 0.684 |
| 1.219 | −0.916 | 0.684 |
| 1.127 | −1.117 | 0.684 |
| 1.042 | −1.291 | 0.684 |
| 0.962 | −1.441 | 0.684 |
| 0.888 | −1.571 | 0.684 |
| 0.817 | −1.684 | 0.684 |
| 0.751 | −1.785 | 0.684 |
| 0.686 | −1.874 | 0.684 |
| 0.624 | −1.953 | 0.684 |
| 0.565 | −2.024 | 0.684 |
| 0.507 | −2.087 | 0.684 |
| 0.453 | −2.142 | 0.684 |
| 0.401 | −2.191 | 0.684 |
| 0.351 | −2.234 | 0.684 |
| 0.301 | −2.272 | 0.684 |
| 0.252 | −2.307 | 0.684 |
| 0.203 | −2.338 | 0.684 |
| 0.155 | −2.367 | 0.684 |
| 0.106 | −2.392 | 0.684 |
| 0.058 | −2.414 | 0.684 |
| 0.011 | −2.434 | 0.684 |
| −0.036 | −2.450 | 0.684 |
| −0.082 | −2.464 | 0.684 |
| −0.129 | −2.476 | 0.684 |
| −0.175 | −2.485 | 0.684 |
| −0.223 | −2.492 | 0.684 |
| −0.272 | −2.497 | 0.684 |
| −0.324 | −2.500 | 0.684 |
| −0.378 | −2.500 | 0.684 |
| −0.436 | −2.497 | 0.684 |
| −0.497 | −2.492 | 0.684 |
| −0.562 | −2.483 | 0.684 |
| −0.628 | −2.472 | 0.684 |
| −0.697 | −2.457 | 0.684 |
| −0.768 | −2.438 | 0.684 |
| −0.840 | −2.416 | 0.684 |
| −0.914 | −2.389 | 0.684 |
| −0.993 | −2.357 | 0.684 |
| −1.078 | −2.319 | 0.684 |
| −1.170 | −2.273 | 0.684 |
| −1.272 | −2.218 | 0.684 |
| −1.384 | −2.152 | 0.684 |
| −1.502 | −2.077 | 0.684 |
| −1.622 | −1.995 | 0.684 |
| −1.741 | −1.908 | 0.684 |
| −1.741 | −1.908 | 0.684 |
| −1.805 | −1.859 | 0.684 |
| −1.864 | −1.812 | 0.684 |
| −1.918 | −1.765 | 0.684 |
| −1.966 | −1.718 | 0.684 |
| −2.007 | −1.671 | 0.684 |
| −2.043 | −1.623 | 0.684 |
| −2.073 | −1.572 | 0.684 |

TABLE 1-continued

| X | Y | Z |
|---|---|---|
| −2.100 | −1.520 | 0.684 |
| −2.120 | −1.467 | 0.684 |
| −2.136 | −1.413 | 0.684 |
| −2.147 | −1.360 | 0.684 |
| −2.153 | −1.306 | 0.684 |
| −2.153 | −1.252 | 0.684 |
| −2.149 | −1.199 | 0.684 |
| −2.141 | −1.147 | 0.684 |
| −2.127 | −1.095 | 0.684 |
| −2.109 | −1.044 | 0.684 |
| −2.085 | −0.993 | 0.684 |
| −2.057 | −0.944 | 0.684 |
| −2.024 | −0.897 | 0.684 |
| −1.985 | −0.850 | 0.684 |
| −1.940 | −0.803 | 0.684 |
| −1.889 | −0.755 | 0.684 |
| −1.833 | −0.708 | 0.684 |
| −1.773 | −0.662 | 0.684 |
| −1.710 | −0.617 | 0.684 |
| −1.641 | −0.571 | 0.684 |
| −1.568 | −0.525 | 0.684 |
| −1.490 | −0.478 | 0.684 |
| −1.409 | −0.430 | 0.684 |
| −1.324 | −0.380 | 0.684 |
| −1.237 | −0.327 | 0.684 |
| −1.148 | −0.270 | 0.684 |
| −1.148 | −0.270 | 0.684 |
| −0.935 | −0.127 | 0.684 |
| −0.731 | 0.018 | 0.684 |
| −0.536 | 0.167 | 0.684 |
| −0.347 | 0.322 | 0.684 |
| −0.164 | 0.484 | 0.684 |
| 0.013 | 0.651 | 0.684 |
| 0.185 | 0.825 | 0.684 |
| 0.352 | 1.003 | 0.684 |
| 0.515 | 1.186 | 0.684 |
| 0.673 | 1.374 | 0.684 |
| 0.829 | 1.567 | 0.684 |
| 0.985 | 1.771 | 0.684 |
| 1.142 | 1.987 | 0.684 |
| 1.298 | 2.213 | 0.684 |
| 1.451 | 2.447 | 0.684 |
| 1.600 | 2.686 | 0.684 |
| 1.744 | 2.927 | 0.684 |
| 1.880 | 3.164 | 0.684 |
| 2.006 | 3.396 | 0.684 |
| 2.125 | 3.622 | 0.684 |
| 2.240 | 3.850 | 0.684 |
| 2.354 | 4.085 | 0.684 |
| 2.354 | 4.085 | 0.684 |
| 2.397 | 4.177 | 0.684 |
| 2.438 | 4.270 | 0.684 |
| 2.477 | 4.364 | 0.684 |
| 2.515 | 4.457 | 0.684 |
| 2.552 | 4.550 | 0.684 |
| 2.589 | 4.643 | 0.684 |
| 2.626 | 4.735 | 0.684 |
| 2.665 | 4.828 | 0.684 |
| 2.671 | 4.884 | 0.770 |
| 2.743 | 5.054 | 0.770 |
| 2.817 | 5.236 | 0.770 |
| 2.894 | 5.432 | 0.770 |
| 2.894 | 5.432 | 0.770 |
| 2.895 | 5.435 | 0.770 |
| 2.897 | 5.436 | 0.770 |
| 2.899 | 5.438 | 0.770 |
| 2.901 | 5.439 | 0.770 |
| 2.904 | 5.439 | 0.770 |
| 2.906 | 5.438 | 0.770 |
| 2.906 | 5.438 | 0.770 |
| 2.921 | 5.434 | 0.770 |
| 2.936 | 5.429 | 0.770 |
| 2.951 | 5.425 | 0.770 |
| 2.951 | 5.425 | 0.770 |
| 2.953 | 5.424 | 0.770 |
| 2.955 | 5.422 | 0.770 |
| 2.957 | 5.420 | 0.770 |
| 2.958 | 5.418 | 0.770 |

TABLE 1-continued

| X | Y | Z |
|---|---|---|
| 2.958 | 5.416 | 0.770 |
| 2.958 | 5.413 | 0.770 |
| 2.958 | 5.413 | 0.770 |
| 2.911 | 5.144 | 0.770 |
| 2.869 | 4.901 | 0.770 |
| 2.825 | 4.681 | 0.770 |
| 2.825 | 4.681 | 0.770 |
| 2.714 | 4.194 | 0.770 |
| 2.652 | 3.933 | 0.770 |
| 2.586 | 3.662 | 0.770 |
| 2.443 | 3.100 | 0.770 |
| 2.405 | 2.957 | 0.770 |
| 2.367 | 2.812 | 0.770 |
| 2.329 | 2.668 | 0.770 |
| 2.290 | 2.526 | 0.770 |
| 2.252 | 2.385 | 0.770 |
| 2.213 | 2.245 | 0.770 |
| 2.175 | 2.107 | 0.770 |
| 2.139 | 1.974 | 0.770 |
| 2.068 | 1.723 | 0.770 |
| 2.001 | 1.488 | 0.770 |
| 1.875 | 1.056 | 0.770 |
| 1.816 | 0.861 | 0.770 |
| 1.788 | 0.769 | 0.770 |
| 1.760 | 0.678 | 0.770 |
| 1.704 | 0.503 | 0.770 |
| 1.650 | 0.334 | 0.770 |
| 1.593 | 0.165 | 0.770 |
| 1.536 | −0.001 | 0.770 |
| 1.422 | −0.317 | 0.770 |
| 1.368 | −0.460 | 0.770 |
| 1.315 | −0.593 | 0.770 |
| 1.215 | −0.832 | 0.770 |
| 1.121 | −1.039 | 0.770 |
| 1.034 | −1.219 | 0.770 |
| 0.954 | −1.373 | 0.770 |
| 0.879 | −1.506 | 0.770 |
| 0.807 | −1.624 | 0.770 |
| 0.740 | −1.728 | 0.770 |
| 0.675 | −1.820 | 0.770 |
| 0.612 | −1.903 | 0.770 |
| 0.551 | −1.977 | 0.770 |
| 0.492 | −2.044 | 0.770 |
| 0.436 | −2.102 | 0.770 |
| 0.382 | −2.154 | 0.770 |
| 0.330 | −2.200 | 0.770 |
| 0.280 | −2.241 | 0.770 |
| 0.231 | −2.277 | 0.770 |
| 0.183 | −2.309 | 0.770 |
| 0.135 | −2.339 | 0.770 |
| 0.088 | −2.365 | 0.770 |
| 0.040 | −2.388 | 0.770 |
| −0.007 | −2.409 | 0.770 |
| −0.055 | −2.427 | 0.770 |
| −0.102 | −2.442 | 0.770 |
| −0.150 | −2.455 | 0.770 |
| −0.198 | −2.466 | 0.770 |
| −0.247 | −2.475 | 0.770 |
| −0.296 | −2.481 | 0.770 |
| −0.347 | −2.485 | 0.770 |
| −0.399 | −2.487 | 0.770 |
| −0.454 | −2.486 | 0.770 |
| −0.512 | −2.483 | 0.770 |
| −0.573 | −2.477 | 0.770 |
| −0.637 | −2.467 | 0.770 |
| −0.704 | −2.455 | 0.770 |
| −0.775 | −2.438 | 0.770 |
| −0.847 | −2.418 | 0.770 |
| −0.922 | −2.394 | 0.770 |
| −1.000 | −2.365 | 0.770 |
| −1.081 | −2.332 | 0.770 |
| −1.167 | −2.292 | 0.770 |
| −1.261 | −2.245 | 0.770 |
| −1.362 | −2.189 | 0.770 |
| −1.467 | −2.127 | 0.770 |
| −1.573 | −2.059 | 0.770 |
| −1.682 | −1.985 | 0.770 |
| −1.794 | −1.904 | 0.770 |

TABLE 1-continued

| X | Y | Z |
|---|---|---|
| −1.794 | −1.904 | 0.770 |
| −1.859 | −1.855 | 0.770 |
| −1.919 | −1.807 | 0.770 |
| −1.974 | −1.760 | 0.770 |
| −2.022 | −1.713 | 0.770 |
| −2.064 | −1.666 | 0.770 |
| −2.100 | −1.617 | 0.770 |
| −2.132 | −1.566 | 0.770 |
| −2.159 | −1.514 | 0.770 |
| −2.180 | −1.460 | 0.770 |
| −2.196 | −1.407 | 0.770 |
| −2.207 | −1.354 | 0.770 |
| −2.213 | −1.300 | 0.770 |
| −2.214 | −1.247 | 0.770 |
| −2.210 | −1.195 | 0.770 |
| −2.201 | −1.143 | 0.770 |
| −2.188 | −1.091 | 0.770 |
| −2.170 | −1.040 | 0.770 |
| −2.146 | −0.989 | 0.770 |
| −2.117 | −0.940 | 0.770 |
| −2.084 | −0.892 | 0.770 |
| −2.045 | −0.845 | 0.770 |
| −2.000 | −0.797 | 0.770 |
| −1.948 | −0.748 | 0.770 |
| −1.892 | −0.700 | 0.770 |
| −1.832 | −0.653 | 0.770 |
| −1.767 | −0.606 | 0.770 |
| −1.698 | −0.559 | 0.770 |
| −1.624 | −0.512 | 0.770 |
| −1.546 | −0.463 | 0.770 |
| −1.463 | −0.413 | 0.770 |
| −1.378 | −0.361 | 0.770 |
| −1.289 | −0.307 | 0.770 |
| −1.199 | −0.249 | 0.770 |
| −1.199 | −0.249 | 0.770 |
| −0.988 | −0.106 | 0.770 |
| −0.787 | 0.040 | 0.770 |
| −0.592 | 0.188 | 0.770 |
| −0.405 | 0.342 | 0.770 |
| −0.222 | 0.503 | 0.770 |
| −0.045 | 0.669 | 0.770 |
| 0.128 | 0.841 | 0.770 |
| 0.295 | 1.017 | 0.770 |
| 0.458 | 1.198 | 0.770 |
| 0.617 | 1.384 | 0.770 |
| 0.773 | 1.574 | 0.770 |
| 0.926 | 1.770 | 0.770 |
| 1.074 | 1.969 | 0.770 |
| 1.219 | 2.174 | 0.770 |
| 1.361 | 2.384 | 0.770 |
| 1.498 | 2.596 | 0.770 |
| 1.631 | 2.809 | 0.770 |
| 1.761 | 3.025 | 0.770 |
| 1.886 | 3.244 | 0.770 |
| 2.008 | 3.465 | 0.770 |
| 2.127 | 3.688 | 0.770 |
| 2.243 | 3.914 | 0.770 |
| 2.356 | 4.143 | 0.770 |
| 2.356 | 4.143 | 0.770 |
| 2.400 | 4.235 | 0.770 |
| 2.441 | 4.328 | 0.770 |
| 2.480 | 4.422 | 0.770 |
| 2.519 | 4.515 | 0.770 |
| 2.556 | 4.607 | 0.770 |
| 2.594 | 4.700 | 0.770 |
| 2.632 | 4.792 | 0.770 |
| 2.671 | 4.884 | 0.770 |
| 2.682 | 4.935 | 0.855 |
| 2.756 | 5.105 | 0.855 |
| 2.831 | 5.287 | 0.855 |
| 2.910 | 5.482 | 0.855 |
| 2.910 | 5.482 | 0.855 |
| 2.911 | 5.484 | 0.855 |
| 2.913 | 5.486 | 0.855 |
| 2.915 | 5.487 | 0.855 |
| 2.917 | 5.488 | 0.855 |
| 2.920 | 5.488 | 0.855 |
| 2.922 | 5.488 | 0.855 |

TABLE 1-continued

| X | Y | Z |
|---|---|---|
| 2.922 | 5.488 | 0.855 |
| 2.937 | 5.483 | 0.855 |
| 2.952 | 5.479 | 0.855 |
| 2.967 | 5.474 | 0.855 |
| 2.967 | 5.474 | 0.855 |
| 2.969 | 5.473 | 0.855 |
| 2.971 | 5.472 | 0.855 |
| 2.972 | 5.470 | 0.855 |
| 2.973 | 5.467 | 0.855 |
| 2.974 | 5.465 | 0.855 |
| 2.973 | 5.463 | 0.855 |
| 2.973 | 5.463 | 0.855 |
| 2.925 | 5.193 | 0.855 |
| 2.881 | 4.949 | 0.855 |
| 2.836 | 4.730 | 0.855 |
| 2.836 | 4.730 | 0.855 |
| 2.728 | 4.269 | 0.855 |
| 2.602 | 3.759 | 0.855 |
| 2.533 | 3.487 | 0.855 |
| 2.496 | 3.347 | 0.855 |
| 2.459 | 3.206 | 0.855 |
| 2.421 | 3.063 | 0.855 |
| 2.382 | 2.917 | 0.855 |
| 2.342 | 2.772 | 0.855 |
| 2.303 | 2.628 | 0.855 |
| 2.264 | 2.486 | 0.855 |
| 2.224 | 2.344 | 0.855 |
| 2.185 | 2.205 | 0.855 |
| 2.147 | 2.070 | 0.855 |
| 2.074 | 1.816 | 0.855 |
| 2.005 | 1.576 | 0.855 |
| 1.875 | 1.137 | 0.855 |
| 1.814 | 0.938 | 0.855 |
| 1.756 | 0.751 | 0.855 |
| 1.646 | 0.409 | 0.855 |
| 1.591 | 0.246 | 0.855 |
| 1.536 | 0.086 | 0.855 |
| 1.479 | −0.073 | 0.855 |
| 1.422 | −0.228 | 0.855 |
| 1.366 | −0.377 | 0.855 |
| 1.311 | −0.517 | 0.855 |
| 1.258 | −0.646 | 0.855 |
| 1.207 | −0.766 | 0.855 |
| 1.110 | −0.981 | 0.855 |
| 1.021 | −1.166 | 0.855 |
| 0.938 | −1.325 | 0.855 |
| 0.861 | −1.462 | 0.855 |
| 0.788 | −1.584 | 0.855 |
| 0.718 | −1.692 | 0.855 |
| 0.652 | −1.788 | 0.855 |
| 0.587 | −1.873 | 0.855 |
| 0.525 | −1.950 | 0.855 |
| 0.464 | −2.019 | 0.855 |
| 0.405 | −2.080 | 0.855 |
| 0.349 | −2.135 | 0.855 |
| 0.295 | −2.183 | 0.855 |
| 0.244 | −2.225 | 0.855 |
| 0.193 | −2.262 | 0.855 |
| 0.144 | −2.296 | 0.855 |
| 0.096 | −2.325 | 0.855 |
| 0.049 | −2.351 | 0.855 |
| 0.001 | −2.375 | 0.855 |
| −0.047 | −2.396 | 0.855 |
| −0.095 | −2.414 | 0.855 |
| −0.144 | −2.430 | 0.855 |
| −0.194 | −2.444 | 0.855 |
| −0.245 | −2.455 | 0.855 |
| −0.296 | −2.464 | 0.855 |
| −0.347 | −2.471 | 0.855 |
| −0.400 | −2.475 | 0.855 |
| −0.454 | −2.477 | 0.855 |
| −0.509 | −2.476 | 0.855 |
| −0.567 | −2.473 | 0.855 |
| −0.628 | −2.466 | 0.855 |
| −0.693 | −2.457 | 0.855 |
| −0.761 | −2.443 | 0.855 |
| −0.835 | −2.426 | 0.855 |
| −0.911 | −2.405 | 0.855 |

TABLE 1-continued

| X | Y | Z |
|---|---|---|
| −0.989 | −2.379 | 0.855 |
| −1.070 | −2.349 | 0.855 |
| −1.154 | −2.314 | 0.855 |
| −1.243 | −2.273 | 0.855 |
| −1.338 | −2.225 | 0.855 |
| −1.437 | −2.170 | 0.855 |
| −1.535 | −2.111 | 0.855 |
| −1.634 | −2.049 | 0.855 |
| −1.737 | −1.979 | 0.855 |
| −1.847 | −1.900 | 0.855 |
| −1.847 | −1.900 | 0.855 |
| −1.911 | −1.852 | 0.855 |
| −1.971 | −1.805 | 0.855 |
| −2.025 | −1.759 | 0.855 |
| −2.073 | −1.713 | 0.855 |
| −2.116 | −1.667 | 0.855 |
| −2.152 | −1.619 | 0.855 |
| −2.184 | −1.570 | 0.855 |
| −2.212 | −1.519 | 0.855 |
| −2.234 | −1.468 | 0.855 |
| −2.251 | −1.416 | 0.855 |
| −2.264 | −1.365 | 0.855 |
| −2.271 | −1.313 | 0.855 |
| −2.274 | −1.262 | 0.855 |
| −2.272 | −1.211 | 0.855 |
| −2.266 | −1.160 | 0.855 |
| −2.256 | −1.110 | 0.855 |
| −2.240 | −1.060 | 0.855 |
| −2.220 | −1.009 | 0.855 |
| −2.194 | −0.960 | 0.855 |
| −2.164 | −0.912 | 0.855 |
| −2.129 | −0.865 | 0.855 |
| −2.089 | −0.818 | 0.855 |
| −2.042 | −0.770 | 0.855 |
| −1.990 | −0.723 | 0.855 |
| −1.934 | −0.676 | 0.855 |
| −1.874 | −0.629 | 0.855 |
| −1.809 | −0.582 | 0.855 |
| −1.741 | −0.535 | 0.855 |
| −1.667 | −0.487 | 0.855 |
| −1.590 | −0.439 | 0.855 |
| −1.508 | −0.389 | 0.855 |
| −1.424 | −0.337 | 0.855 |
| −1.337 | −0.283 | 0.855 |
| −1.248 | −0.225 | 0.855 |
| −1.248 | −0.225 | 0.855 |
| −1.035 | −0.080 | 0.855 |
| −0.831 | 0.067 | 0.855 |
| −0.635 | 0.218 | 0.855 |
| −0.445 | 0.373 | 0.855 |
| −0.259 | 0.536 | 0.855 |
| −0.080 | 0.704 | 0.855 |
| 0.095 | 0.878 | 0.855 |
| 0.265 | 1.056 | 0.855 |
| 0.431 | 1.239 | 0.855 |
| 0.593 | 1.426 | 0.855 |
| 0.751 | 1.619 | 0.855 |
| 0.906 | 1.815 | 0.855 |
| 1.056 | 2.016 | 0.855 |
| 1.204 | 2.223 | 0.855 |
| 1.348 | 2.433 | 0.855 |
| 1.487 | 2.646 | 0.855 |
| 1.622 | 2.860 | 0.855 |
| 1.754 | 3.077 | 0.855 |
| 1.881 | 3.296 | 0.855 |
| 2.006 | 3.518 | 0.855 |
| 2.127 | 3.742 | 0.855 |
| 2.245 | 3.968 | 0.855 |
| 2.360 | 4.197 | 0.855 |
| 2.360 | 4.197 | 0.855 |
| 2.405 | 4.289 | 0.855 |
| 2.447 | 4.382 | 0.855 |
| 2.487 | 4.475 | 0.855 |
| 2.526 | 4.567 | 0.855 |
| 2.564 | 4.660 | 0.855 |
| 2.603 | 4.752 | 0.855 |
| 2.642 | 4.844 | 0.855 |
| 2.682 | 4.935 | 0.855 |

TABLE 1-continued

| X | Y | Z |
|---|---|---|
| 2.687 | 4.953 | 0.886 |
| 2.761 | 5.121 | 0.884 |
| 2.837 | 5.302 | 0.882 |
| 2.916 | 5.496 | 0.881 |
| 2.916 | 5.496 | 0.881 |
| 2.917 | 5.498 | 0.881 |
| 2.918 | 5.500 | 0.881 |
| 2.921 | 5.501 | 0.880 |
| 2.923 | 5.502 | 0.880 |
| 2.925 | 5.502 | 0.880 |
| 2.928 | 5.502 | 0.880 |
| 2.928 | 5.502 | 0.880 |
| 2.943 | 5.497 | 0.880 |
| 2.957 | 5.492 | 0.880 |
| 2.972 | 5.487 | 0.879 |
| 2.972 | 5.487 | 0.879 |
| 2.974 | 5.486 | 0.879 |
| 2.976 | 5.485 | 0.879 |
| 2.978 | 5.483 | 0.879 |
| 2.979 | 5.480 | 0.879 |
| 2.979 | 5.478 | 0.879 |
| 2.979 | 5.476 | 0.879 |
| 2.979 | 5.476 | 0.879 |
| 2.930 | 5.206 | 0.880 |
| 2.886 | 4.963 | 0.881 |
| 2.840 | 4.745 | 0.882 |
| 2.840 | 4.745 | 0.882 |
| 2.770 | 4.444 | 0.884 |
| 2.698 | 4.144 | 0.886 |
| 2.623 | 3.845 | 0.887 |
| 2.546 | 3.545 | 0.889 |
| 2.467 | 3.245 | 0.891 |
| 2.385 | 2.942 | 0.893 |
| 2.300 | 2.637 | 0.894 |
| 2.214 | 2.330 | 0.896 |
| 2.126 | 2.023 | 0.898 |
| 2.037 | 1.717 | 0.900 |
| 1.946 | 1.412 | 0.902 |
| 1.854 | 1.107 | 0.905 |
| 1.757 | 0.799 | 0.907 |
| 1.705 | 0.639 | 0.908 |
| 1.651 | 0.474 | 0.909 |
| 1.591 | 0.299 | 0.910 |
| 1.560 | 0.209 | 0.911 |
| 1.529 | 0.119 | 0.912 |
| 1.394 | −0.248 | 0.915 |
| 1.360 | −0.336 | 0.916 |
| 1.325 | −0.423 | 0.916 |
| 1.257 | −0.589 | 0.918 |
| 1.191 | −0.744 | 0.920 |
| 1.125 | −0.889 | 0.921 |
| 0.998 | −1.151 | 0.924 |
| 0.877 | −1.377 | 0.927 |
| 0.761 | −1.571 | 0.929 |
| 0.650 | −1.736 | 0.932 |
| 0.545 | −1.874 | 0.934 |
| 0.444 | −1.992 | 0.936 |
| 0.444 | −1.992 | 0.936 |
| 0.349 | −2.089 | 0.939 |
| 0.261 | −2.169 | 0.941 |
| 0.177 | −2.235 | 0.942 |
| 0.096 | −2.290 | 0.944 |
| 0.096 | −2.290 | 0.944 |
| 0.018 | −2.335 | 0.946 |
| −0.060 | −2.373 | 0.948 |
| −0.140 | −2.404 | 0.950 |
| −0.222 | −2.429 | 0.951 |
| −0.307 | −2.448 | 0.953 |
| −0.395 | −2.461 | 0.955 |
| −0.484 | −2.467 | 0.957 |
| −0.576 | −2.467 | 0.959 |
| −0.673 | −2.459 | 0.962 |
| −0.780 | −2.443 | 0.964 |
| −0.899 | −2.417 | 0.967 |
| −1.029 | −2.379 | 0.970 |
| −1.167 | −2.329 | 0.973 |
| −1.311 | −2.267 | 0.976 |
| −1.459 | −2.191 | 0.979 |

TABLE 1-continued

| X | Y | Z |
|---|---|---|
| −1.610 | −2.105 | 0.983 |
| −1.765 | −2.007 | 0.986 |
| −1.930 | −1.893 | 0.990 |
| −1.930 | −1.893 | 0.990 |
| −2.001 | −1.840 | 0.992 |
| −2.071 | −1.786 | 0.993 |
| −2.135 | −1.731 | 0.995 |
| −2.191 | −1.677 | 0.996 |
| −2.236 | −1.624 | 0.997 |
| −2.273 | −1.573 | 0.998 |
| −2.303 | −1.522 | 0.998 |
| −2.328 | −1.471 | 0.999 |
| −2.348 | −1.420 | 0.999 |
| −2.362 | −1.369 | 1.000 |
| −2.372 | −1.318 | 1.000 |
| −2.376 | −1.267 | 1.000 |
| −2.376 | −1.215 | 1.000 |
| −2.372 | −1.164 | 1.000 |
| −2.362 | −1.112 | 1.000 |
| −2.348 | −1.060 | 0.999 |
| −2.328 | −1.007 | 0.999 |
| −2.303 | −0.955 | 0.998 |
| −2.273 | −0.904 | 0.998 |
| −2.237 | −0.854 | 0.997 |
| −2.197 | −0.805 | 0.996 |
| −2.149 | −0.756 | 0.995 |
| −2.095 | −0.706 | 0.994 |
| −2.037 | −0.657 | 0.992 |
| −1.974 | −0.608 | 0.991 |
| −1.907 | −0.560 | 0.989 |
| −1.835 | −0.512 | 0.988 |
| −1.758 | −0.462 | 0.986 |
| −1.676 | −0.411 | 0.984 |
| −1.589 | −0.359 | 0.982 |
| −1.499 | −0.305 | 0.980 |
| −1.406 | −0.249 | 0.978 |
| −1.312 | −0.189 | 0.976 |
| −1.312 | −0.189 | 0.976 |
| −1.201 | −0.117 | 0.974 |
| −1.091 | −0.042 | 0.971 |
| −0.982 | 0.034 | 0.969 |
| −0.875 | 0.110 | 0.966 |
| −0.769 | 0.189 | 0.964 |
| −0.657 | 0.275 | 0.961 |
| −0.532 | 0.375 | 0.958 |
| −0.391 | 0.493 | 0.955 |
| −0.236 | 0.630 | 0.952 |
| −0.075 | 0.780 | 0.948 |
| 0.090 | 0.942 | 0.944 |
| 0.261 | 1.118 | 0.941 |
| 0.435 | 1.307 | 0.937 |
| 0.603 | 1.500 | 0.933 |
| 0.768 | 1.698 | 0.929 |
| 0.932 | 1.905 | 0.925 |
| 1.097 | 2.124 | 0.922 |
| 1.261 | 2.353 | 0.918 |
| 1.421 | 2.588 | 0.914 |
| 1.576 | 2.827 | 0.911 |
| 1.725 | 3.066 | 0.907 |
| 1.866 | 3.302 | 0.904 |
| 1.998 | 3.532 | 0.901 |
| 2.123 | 3.758 | 0.898 |
| 2.243 | 3.986 | 0.896 |
| 2.363 | 4.220 | 0.893 |
| 2.363 | 4.220 | 0.893 |
| 2.408 | 4.311 | 0.892 |
| 2.450 | 4.403 | 0.891 |
| 2.491 | 4.495 | 0.890 |
| 2.530 | 4.587 | 0.889 |
| 2.569 | 4.679 | 0.888 |
| 2.607 | 4.771 | 0.888 |
| 2.646 | 4.862 | 0.887 |
| 2.687 | 4.953 | 0.886 |

Although a preferred embodiment of this invention has been disclosed, a worker of ordinary skill in this art would recognize that certain modifications would come within the scope of this invention. For that reason, the following claims should be studied to determine the true scope and content of this invention. Since many possible embodiments may be made of the invention without departing from the scope thereof, it is to be understood that all matter herein set forth or shown in the accompanying drawings is to be interpreted as illustrative and not in a limiting sense.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. A turbine nozzle comprising an airfoil, the airfoil having a shape within an envelope of −0.049 to +0.049 inches in a direction normal to any surface of the airfoil, the airfoil comprises a nominal uncoated profile substantially in accordance with Cartesian coordinate values of X, Y, and Z set forth in Table 1, wherein the Z values are non-dimensional values from 0 to 1 convertible to Z distances in inches by multiplying the Z values by a height of the airfoil in inches and adding that product to a root radius of the turbine nozzle, and wherein X and Y are distances in inches in which, when connected by smooth continuing arc, define airfoil profile sections at each Z value, the profile sections at the Z values being joined smoothly with one another to form a complete airfoil shape.

2. The turbine nozzle of claim 1 forming part of a first stage of a gas turbine engine.

3. The turbine nozzle of claim 1 further comprising an inner radial platform secured to the airfoil at a root of the airfoil and an outer radial platform secured to the airfoil at a tip of the airfoil.

4. The turbine nozzle of claim 3, wherein the Z value is measured from a distance midway along an axial length of the inner radial platform.

5. The turbine nozzle of claim 4, wherein the turbine nozzle has an airfoil height of seven inches as measured from the inner radial platform.

6. The turbine nozzle of claim 1 further comprising a coating applied to the airfoil.

7. The turbine nozzle of claim 6, wherein the coating comprises a metallic MCrAlY with a diffused aluminide overlay applied up to 0.012 inches thick and a thermal barrier coating applied up to 0.023 inches thick over the metallic MCrAlY coating.

8. The turbine nozzle of claim 1, wherein X and Y comprise distances being scalable as a function of the same constant or number to provide a scaled up or scaled down nozzle airfoil.

9. A turbine nozzle comprising an airfoil, the airfoil having a shape comprising a nominal uncoated profile substantially in accordance with Cartesian coordinate values of X, Y, and Z set forth in Table 1, wherein the Z values are non-dimensional values from 0 to 1 convertible to Z distances in inches by multiplying the Z values by a height of the airfoil in inches and adding that product to a root radius of the turbine nozzle, and wherein X and Y are distances in inches in which, when connected by smooth continuing arc, define airfoil profile sections at each distance Z, the profile sections at the Z distances being joined smoothly with one another to form a complete airfoil shape.

10. The turbine nozzle of claim 9 forming part of a first stage of a gas turbine engine.

11. The turbine nozzle of claim 9 further comprising an inner radial platform secured to the airfoil at a root of the airfoil and an outer radial platform secured to the airfoil at a tip of the airfoil.

12. The turbine nozzle of claim 11, wherein the Z value is measured from a distance midway along an axial length of the inner radial platform.

13. The turbine nozzle of claim 12, wherein the turbine nozzle has an airfoil height of seven inches as measured from the inner radial platform.

14. The turbine nozzle of claim 9 further comprising a coating applied to the airfoil.

15. The turbine nozzle of claim 14, wherein the coating comprises a metallic MCrAlY with a diffused aluminide overlay applied up to 0.012 inches thick and a thermal barrier coating applied 0.023 inches thick over the metallic MCrAlY coating.

16. An assembly of first stage turbine nozzles, with each nozzle comprising an airfoil having a shape within an envelope of −0.049 to +0.049 inches in a direction normal to any surface of the airfoil, the airfoil comprises a nominal uncoated profile substantially in accordance with Cartesian coordinate values of X, Y, and Z set forth in Table 1, wherein the Z values are non-dimensional values from 0 to 1 convertible to Z distances in inches by multiplying the Z values by a height of the airfoil in inches and adding that product to a root radius of the turbine nozzle, and wherein X and Y are distances in inches in which, when connected by smooth continuing arc, define airfoil profile sections at each distance Z, the profile sections at the Z distances being joined smoothly with one another to form a complete airfoil shape.

17. The turbine nozzle of claim 16 further comprising an inner radial platform secured to the airfoil at a root of the airfoil and an outer radial platform secured to the airfoil at a tip of the airfoil.

18. The turbine nozzle of claim 17, wherein the turbine nozzle has an airfoil height of seven inches as measured from the inner radial platform.

19. The turbine nozzle of claim 18 further comprising a coating applied to the airfoil where the coating comprises a metallic MCrAlY with a diffused aluminide overlay applied up 0.012 inches thick and a thermal barrier coating applied 0.023 inches thick over the metallic MCrAlY coating.

20. The turbine nozzle of claim 16, wherein X and Y comprise distances being scalable as a function of the same constant or number to provide a scaled up or scaled down nozzle airfoil.

* * * * *